United States Patent [19]

Nakajima et al.

[11] Patent Number: 4,744,732

[45] Date of Patent: May 17, 1988

[54] VARIABLE CAPACITY VANE COMPRESSOR

[75] Inventors: Nobuyuki Nakajima; Kenichi Inomata; Shigeru Okada, all of Konan, Japan

[73] Assignee: Diesel Kiki Co., Ltd., Tokyo, Japan

[21] Appl. No.: 946,425

[22] Filed: Dec. 23, 1986

[30] Foreign Application Priority Data

| | | | |
|---|---|---|---|
| Dec. 28, 1985 | [JP] | Japan | 60-299054 |
| Jan. 31, 1986 | [JP] | Japan | 61-019936 |
| Jan. 31, 1986 | [JP] | Japan | 61-019937 |
| Feb. 19, 1986 | [JP] | Japan | 61-035880 |
| Mar. 22, 1986 | [JP] | Japan | 61-064460 |
| May 12, 1986 | [JP] | Japan | 61-107881 |

[51] Int. Cl.[4] ..... F04B 49/02; F04B 49/08

[52] U.S. Cl. ..... 417/295; 417/310; 418/15; 418/78

[58] Field of Search ..... 417/310, 440, 295; 418/15, 78

[56] References Cited

U.S. PATENT DOCUMENTS

| | | | |
|---|---|---|---|
| 3,451,614 | 6/1969 | Tosh | 417/440 |
| 3,515,496 | 6/1970 | Eddy | 417/440 |
| 3,799,707 | 3/1974 | Newton | 418/270 |
| 4,060,343 | 11/1977 | Newton | 418/78 |
| 4,137,018 | 1/1979 | Brucken | 418/78 |
| 4,498,853 | 2/1985 | Sakamaki | 417/310 |
| 4,566,869 | 1/1986 | Pandeya | 418/15 |
| 4,621,986 | 11/1986 | Sudo | 417/310 |

FOREIGN PATENT DOCUMENTS

| | | | |
|---|---|---|---|
| 552000 | 1/1980 | Japan . | |
| 137813 | 2/1984 | Japan | 417/270 |
| 196991 | 11/1984 | Japan | 417/310 |
| 62-20688 | 1/1987 | Japan . | |

*Primary Examiner*—William L. Freeh

*Attorney, Agent, or Firm*—Frishauf, Holtz, Goodman & Woodward

[57] ABSTRACT

A variable capacity vane compressor comprises additional refrigerant inlet ports formed in one of front and rear side blocks of a cylinder accommodating a rotor, and communicating a suction chamber with a compression chamber on a suction stroke, and a control element received in a recess formed in an end face of the above one side block facing the rotor, for rotation to vary the opening angle of the additional inlet ports to thereby control the compression commencing timing of compression medium. At least one spacer is interposed between the control element and at least one of the above one side block and the rotor, for maintaining a predetermined minimum clearance therebetween.

22 Claims, 19 Drawing Sheets

VARIABLE CAPACITY VANE COMPRESSOR

BACKGROUND OF THE INVENTION

This invention relates to variable capacity vane compressors which are adapted for use as refrigerant compressors of air conditioners for automotive vehicles.

A variable capacity vane compressor is known e.g. by Japanese Provisional Utility Model Publication (Kokai) No. 55-2000 filed by the same assignee of the present application, which is capable of controlling the capacity of the compressor by varying the suction quantity of a gas to be compressed. According to this known vane compressor, arcuate slots are formed in a peripheral wall of the cylinder and each extend from a lateral side of a refrigerant inlet port formed through the same peripheral wall of the cylinder and also through an end plate of the cylinder, and in which is slidably fitted a throttle plate, wherein the effective circumferential length of the opening of the refrigerant inlet port is varied by displacing the throttle plate relative to the slot so that the compression commencing position in a compression chamber defined in the cylinder and accordingly the compression stroke period varies to thereby vary the capacity or delivery quantity of the compressor. A link member is coupled at one end to the throttle plate via a support shaft secured to the end plate,and at the other end to an actuator so that the link member is pivotally displaced by the actuator to displace the throttle plate.

However, according to the conventional vane compressor, because of the intervention of the link member between driving means or the actuator and a control element or the throttle plate for causing displacement of the trottle plate, the thorttle plate undergoes a large hysteresis, leading to low reliability in controlling the compressor capacity, and also the capacity control mechanism using the link member, etc. requires complicated machining and assemblage.

To solve the above problem, a variable capacity vane compressor has been proposed e.g. by Japanese Patent Application No. 60-160760, which comprises a front side block which has an end face facing the rotor and formed with an annular recess and additional refrigerant inlet ports continuous with the annular recess and communicating respective .compression chambers within the cylinder with the suction chamber, an annular control element rotatably received within the annular recess, and means responsive to a differential pressure between a high pressure such as discharge refrigerant pressure and a low pressure such as suction refrigerant pressure for causing rotation of the annular control element, wherein the rotation of the control element causes the openings of the additional inlet ports and accordingly the compression stroke period to vary to thereby vary the capacity of the compressor.

However, according to this proposed variable capacity compressor, there is provided a considerable clearance between the rotor and the control element which amounts to the sum of a first clearance for allowing smooth rotation of the rotor and a second clearance for allowing smooth rotation of the control element. The presence of such large clearance causes an apreciable amount of refrigerant to leak from the compression chambers into the suction chamber through the clearance an the additional refrigerant inlet ports, which necessitates a great driving force for rotating the rotor, resulting undesirable heat generation in sliding parts of the compressor and increased temperature of the discharged refrigerant.

Furthermore, in vane compressors in general pressure within a high pressure chamber is supplied to radially inner end faces of the vanes as back pressure to maintain steady contact of tips of the vanes with the inner peripheral or camming surface of the cam ring. However, according to the aforesaid conventional vane compressors adapted to vary the compression commencing position, when the compression stroke period is reduced to decrease the capacity, the back pressure applied to the vanes correspondingly decreases, causing chattering of the vanes, i.e. alternate jumping and hitting of the vanes off and against the camming inner peripheral surface of the cam ring, resulting in degraded compression efficiency. If the supply amount of pressure from the high pressure chamber to the vanes is set at a larger value so as to obtain sufficient back pressure to be applied to the vanes when the compression stroke period is reduced to decrease the capacity, excessive back pressure is applied to the vanes when the compression stroke period is increased to increase the capacity, resulting in increased sliding friction and hence increased loss of power.

Moreover, to enhance the reliability of control of the capacity of variable capacity vane compressors of the aforesaid type it is desirable that sliding displacement of the control element or throttle plate in the slot should take place smoothly and promptly or with high responsiveness to operating conditions of the compressor.

SUMMARY OF THE INVENTION

It is an object of the invention to provide a variable capacity vane compressor which has a capacity control mechanism which is simple in structure and compact in size, thus facilitating the assemblage and reducing the low manufacturing cost, but is capable of controlling the compressor capacity with high reliability.

A further object of the invention is to provide moderate clearances between component parts of the compressor to minimize the amount of leakage refrigerant enough to keep the rotor driving force small and the discharge refrigerant temperature low, as well as to attain smooth sliding movement of the control element for accurate control of the compressor capacity.

Another object of the invention is to maintain the back pressure acting upon the vanes nearly constant even upon change of the compressor capacity, thereby preventing chattering of the vanes and loss of power.

Still another object of the invention is to enhance the responsiveness of the control element for varying the compressor capacity to changes in the operating condition of the compressor.

To attain the objects, the invention provides a variable capacity vane compressor including a cylinder formed of a cam ring and a pair of front and rear side blocks closing opposite ends of the cam ring, the cylinder having at least one first inlet port formed therein, a rotor rotatably received within the cylinder, a plurality of vanes radially slidably fitted in respective slits formed in the rotor, a housing accommodating the cylinder and defining a suction chamber and a discharge pressure chamber therein, a driving shaft on which the rotor is secured, the driving shaft extending through the front side block, and power transmitting means mounted on the driving shaft at a side of the front side block remote from the rotor, wherein compression chambers are defined between the cylinder, the rotor and adjacent ones of the vanes and vary in volume with rotation of the rotor for effecting suction of a compression medium from the suction chamber into the compression chambers through the at least one first inlet port, and compression and discharge of the compression medium.

At least one second inlet port is formed in the one of the front and rear side blocks and adjacent a corresponding one of the at least one first inlet port, the at least one second inlet port communicating the suction chamber with at least one of the compression chambers which is on a suction stroke. A control element is arranged in a recess formed in an end face of the one of the front and rear side blocks facing the rotor for rotation about an axis common with an axis of rotation of the rotor. The control element is so disposed that circumferential position thereof determines the opening angle of the at least one second inlet port to thereby determine the timing of commencement of the compression of the compression medium. Spacer means is interposed between the control element and at least one of the one of the front and rear side blocks and the rotor, for maintaining a predetermined minimum clearance therebetween.

Preferably, the cam ring and the rotor have end faces thereof facing the one of the front and rear side block and axially flush with each other. Alternatively, the end face of the rotor is slightly inserted into the recess formed in the end face of the one of the front and rear side block facing the rotor.

Also preferably, a plurality of circumferentially arranged back pressure ports open into the recess formed in the end face of the one of the front and rear side blocks facing the rotor and are communicatable with back pressure chambers defined, respectively, in the rotor slits and opening in the end face of the rotor facing the one of the front and rear side blocks. A communication passageway communicates the back pressure ports with the discharge pressure chamber. The control element has a cut-out portion formed therein at a location radially corresponding to the back pressure ports. The control element is so disposed that as the control element is circumferentially displaced to increase the opening angle of the at least one second inlet port, the cut-out portion successively opens the back pressure ports to thereby increase the total opening area of the back pressure ports.

Preferably, the control element has a pressure-receiving portion defining a first pressure chamber supplied with a high pressure from the discharge pressure chamber and a second pressure chamber supplied with a low pressure from the suction chamber, the first and second pressure chambers being arranged in the one of the front and rear side blocks, the pressure-receiving portion being circumferentially displaceable in response to a difference between the high pressure in the second pressure chamber for low pressure in the second pressure chamber for causing circumferential displacement of the control element to vary the opening angle of the at least one second inlet port. A communication passageway communicates the first pressure chamber with the suction chamber. Control valve means is responsive to pressure within the suction chamber for closing the communication passageway when the pressure within the suction chamber is higher than a first predetermined value and for opening the communication passageway when the pressure within the suction chamber is lower than the first predetermined value to thereby vary the high pressure in the first pressure chamber. Capacity-increasing means is responsive to the pressure within the suction chamber for causing circumferential displacement of the control element in a direction in which the opening angle of the at least one second inlet port decreases when the pressure within the suction chamber is higher than a second predetermined value.

Further, preferably, a first communication passageway having a restriction therein communicates the first pressure chamber with the discharge pressure chamber. A second communication passageway communicates the first pressure chamber with the suction chamber. The control valve means is now responsive to pressure within the suction chamber for closing the second communication passageway when the pressure within the suction chamber is higher than a first predetermined value and for opening the second communication passageway when the pressure within the suction chamber is lower than the first predetermined value to thereby vary the high pressure in the first pressure chamber. A third communication passageway communicates the first pressure chamber with the discharge pressure chamber in a manner bypassing the first communication passageway. Bypass valve means is arranged in the third communication passageway and responsive to pressure from the discharge pressure chamber for opening the third communication passageway when the pressure from the discharge pressure chamber is lower than a second predetermined value and for closing the third communication passageway when the pressure from the discharge pressure chamber is higher than the second predetermined value.

The above and other objects, features and advantages of the invention will be more apparent from the ensuing detailed description taken in conjunction with the accompanying drawings wherein like reference characters designate corresponding elements and parts throughout all the views.

DETAILED DESCRIPTION

Figure 1:
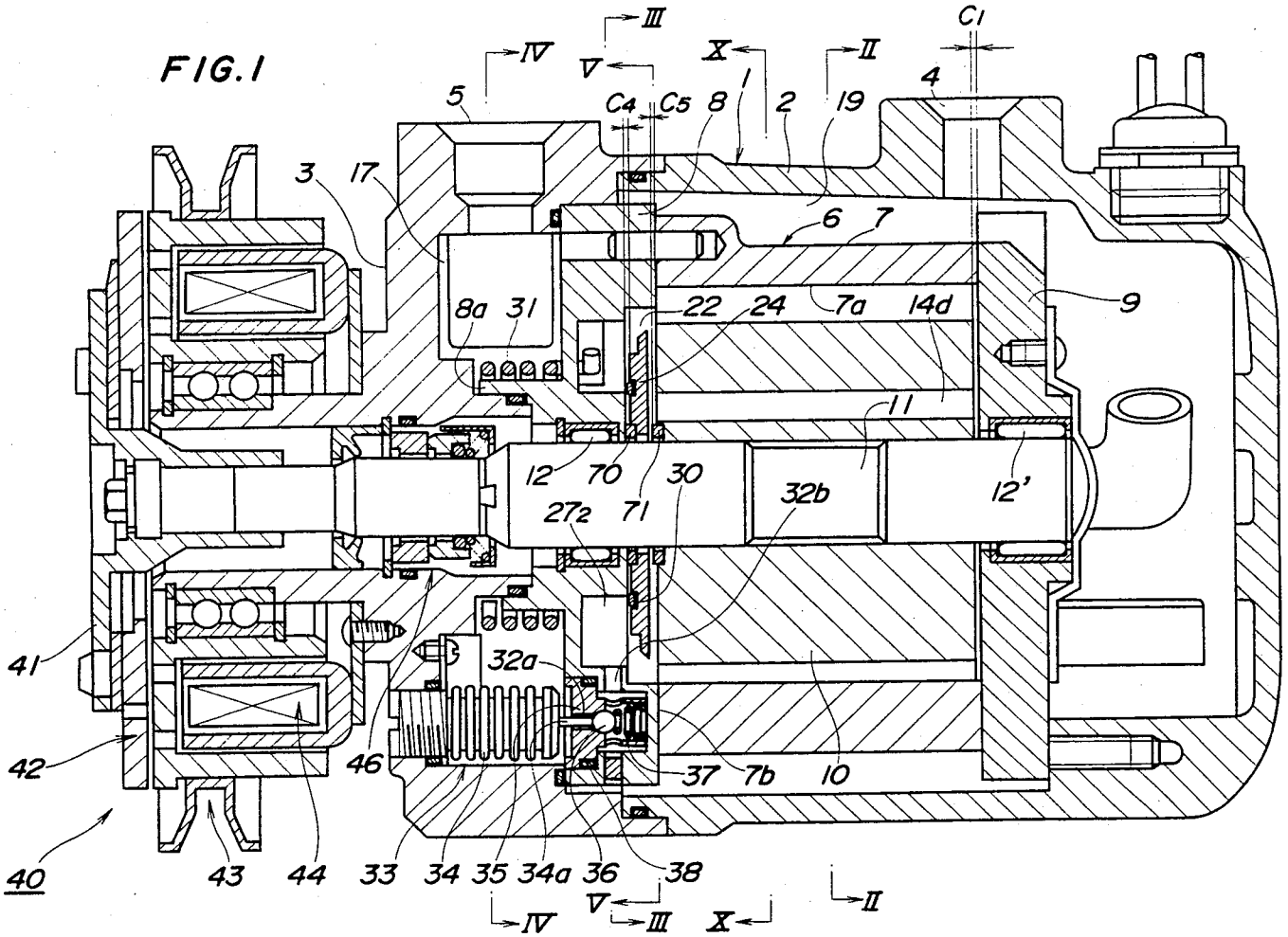
FIG. 1 is a longitudinal sectional view of a variable capacity vane compressor according to a first embodiment of the invention.

The invention will now be described in detail with reference to the drawings showing embodiments thereof.

FIGS. 1 through 12 show a variable capacity vane compressor according to a first embodiment of the invention, wherein a housing 1 comprises a cylindrical casing 2 with an open end, and a front head 3, which is fastened to the casing 2 by means of bolts, not shown, in a manner closing the open end of the casing 2. A discharge port 4, through which a refrigerant gas is to be discharged as a thermal medium, is formed in an upper wall of the casing 2 at a rear end thereof, and a suction port 5, through which the refrigerant gas is to be drawn into the compressor, is formed in an upper portion of the front head 3. The discharge port 4 and the suction port 5 communicate, respectively, with a discharge pressure chamber and a suction chamber, both hereinafter referred to.

A pump body 6 is housed in the housing 1. The pump body 6 is composed mainly of a cylinder formed by a cam ring 7, and a front side block 8 and a rear side block 9 closing open opposite ends of the cam ring 7, a cylindrical rotor 10 rotatably received within the cylinder, and a driving shaft 11 on which is secured the rotor 10. The driving shaft 11 is rotatably supported by a pair of radial bearings 12 and 12' provided in the side blocks 8 and 9, respectively. The driving shaft 11 extends through the front side block 8 and the front head 3 while being sealed in an airtight manner against the interior of the compressor by means of mechanical sealing means 46 provided around the shaft 11 in the front head 3.

Figure 2:
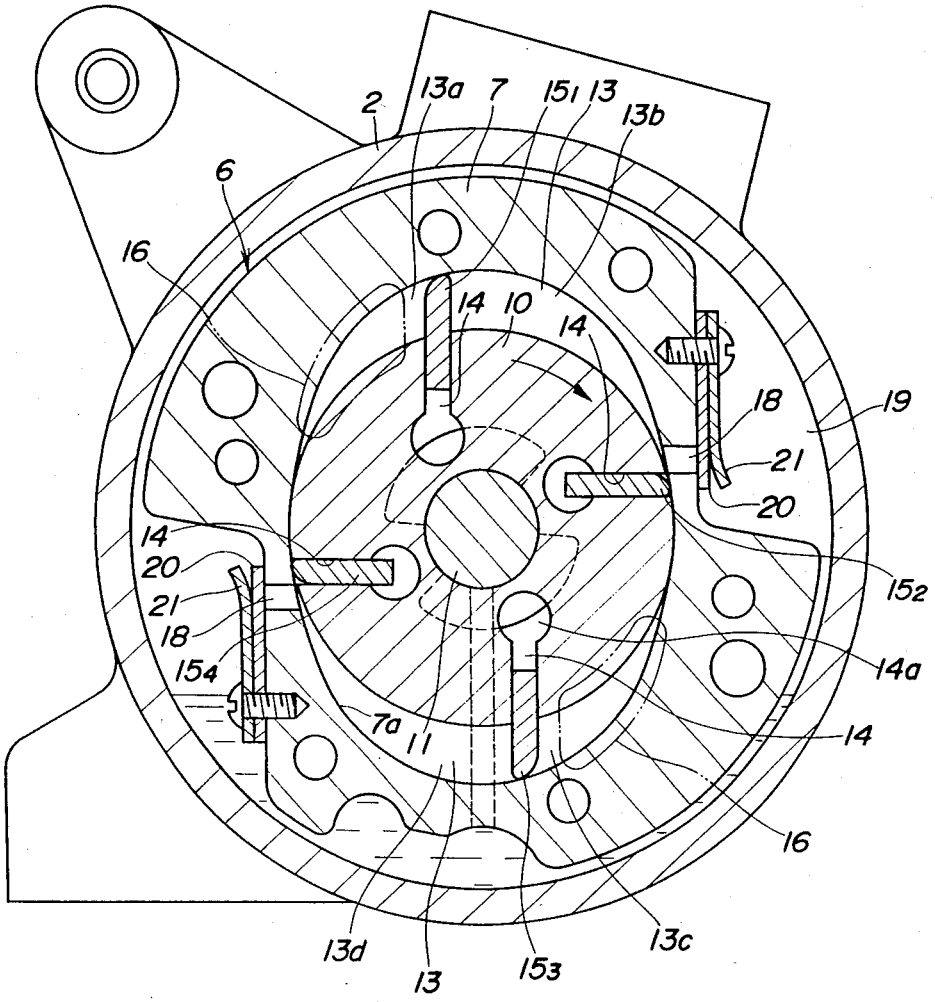
FIG. 2 is a transverse sectional view taken along line II—II in FIG. 1.

The cam ring 7 has an inner peripheral surface 7*a* with an elliptical cross section, as shown in FIG. 2, and cooperates with the rotor 10 to define therebetween a pair of spaces 13 and 13 at diametrically opposite locations.

The rotor 10 has its outer peripheral surface formed with a plurality of (four in the illustrated embodiment) axial vane slits 14 at circumferentially equal intervals, in each of which a vane $15_1$–$15_4$ is radially slidably fitted. Adjacent vanes $15_1$–$15_4$ define therebetween four compression chambers 13*a*–13*d* in cooperation with the cam ring 7, the rotor 10, and the opposite inner end faces of the front and rear side blocks 8, 9. The axial vane slits 14 open in opposite end faces of the rotor 10.

Refrigerant inlet ports 16 and 16 are formed in the front side block 8 at diametrically opposite locations as shown in FIGS. 2 through 7. These refrigerant inlet ports 16, 16 are located at such locations that they become closed when the respective compression chambers 13*a*–13*d* assume their largest volumes. These refrigerant inlet ports 16, 16 axially extend in the front side block 8, and through which a suction chamber (lower pressure chamber) 17 defined in the front head 3 by the front side block 8 and spaces 13 or compression chambers 13*a* and 13*c* on the suction stroke are communicated with each other.

Refrigerant outlet ports 18, 18 are formed through opposite lateral side walls of the cam ring 7 and through which spaces 13 or compression chambers 13*b* and 13*d* on the discharge stroke are communicated with the discharge pressure chamber (higher pressure chamber) 19 defined within the casing 2. These refrigerant outlet ports 18, 18 are provided with respective discharge valves 20 and valve retainers 21, as shown in FIG. 2.

Figure 5:
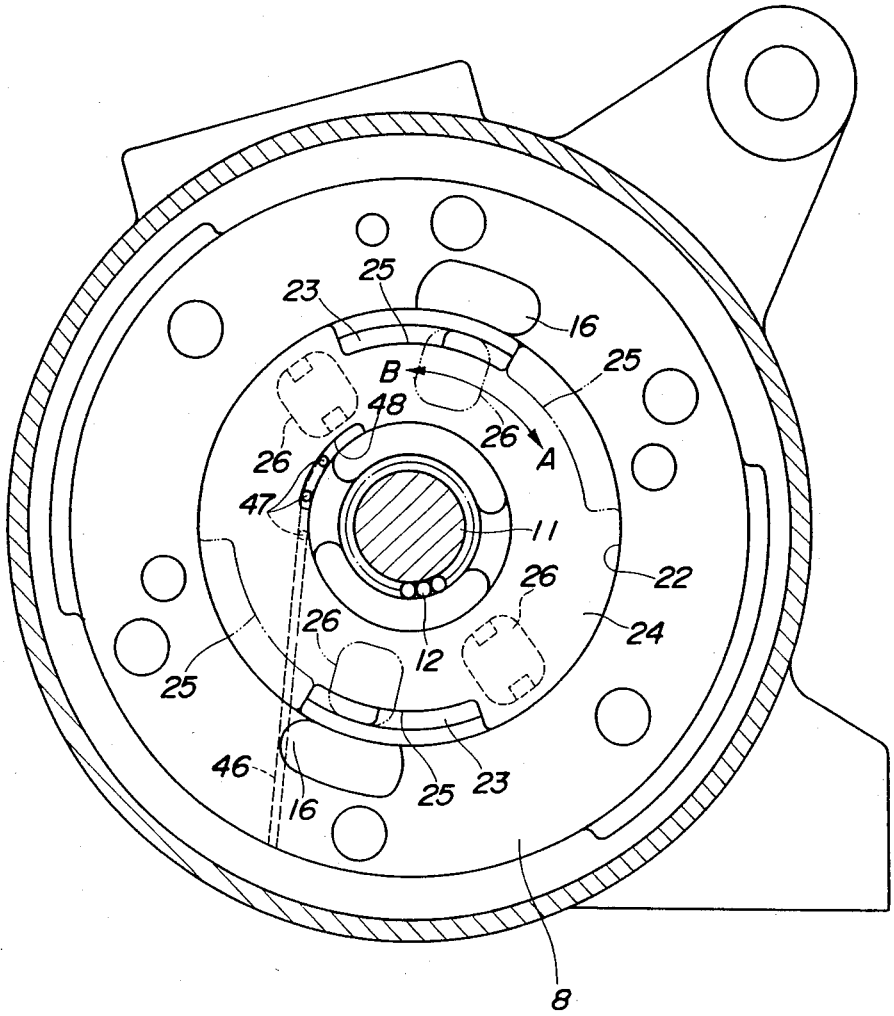
FIG. 5 is a transverse sectional view taken along line V—V in FIG. 1.
Figure 7:
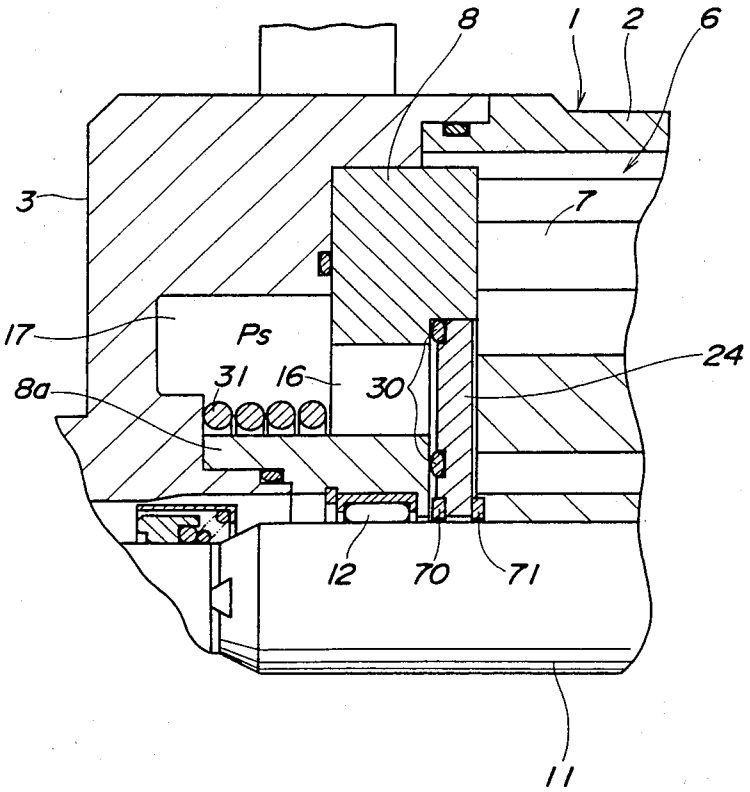
FIG. 7 is a view similar to FIG. 6, showing an essential part of the compressor at full capacity operation.
Figure 6:
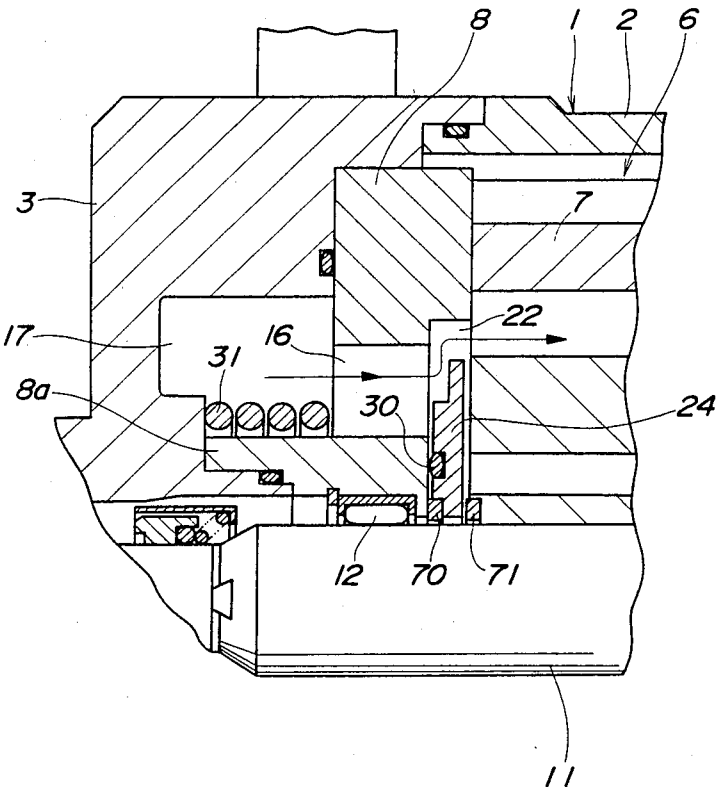
FIG. 6 is a fragmentary longitudinal sectional view taken along line VI—VI in FIG. 4, showing an essential part of the compressor at partial capacity operation.

The front side block 8 has an end face facing the rotor 10, in which is formed an annular recess 22 larger in diameter than the rotor 10, as best shown in FIGS. 5 through 7. Due to the presence of the annular recess 22, no part of the end face of the rotor 10 facing the front side block 8 is in contact with the opposed end face of the latter. A pair of second refrigerant inlet ports 23 and 23 in the form of arcuate openings are formed in the front side block 8 at diametrically opposite locations and circumferentially extend continuously with the annular recess 22 along its outer periphery, as best shown in FIG. 5, and through which the suction chamber 17 is communicated with the compression chambers 13*a*, 13*c* on the suction stroke. These second inlet ports 23, 23 open into the compression chambers 13*a*, 13*c* at circumferential locations in advance of the locations of the respective refrigerant inlet ports 16, 16 in the direction in which the vanes $15_1$–$15_4$ rotate. An annular control element 24 is received in the annular recess 22 for rotation in opposite circumferential directions to control the opening angle of the second inlet ports 23, 23. The control element 24 has its outer peripheral edge formed with a pair of diametrically opposite arcuate cut-out portions 25 and 25, and its one side surface formed integrally with a pair of diametrically opposite partition plates 26 and 26 axially projected therefrom and acting as pressure-receiving elements. The partition plates 26, 26 are slidably received in respective arcuate spaces 27 and 27 which are formed in the front side block 8 in a manner continuous with the annular recess 22 and circumferentially partially overlapping with the respective second inlet ports 23, 23. The interior of each of the arcuate spaces 27, 27 is divided into first and second pressure chambers $27_1$ and $27_2$ by the associated partition plate 26. The first pressure chamber $27_1$ communicates with the suction chamber 17 through the corresponding inlet port 16 and the corresponding second inlet port 23, and the second pressure chamber $27_2$ communicates with the discharge pressure chamber 19 through a restriction passage 28 formed in the front side block 8. The two chambers $27_1$, $27_2$ are communicated with each other by way of a communication passage 29 formed in the control element 24.

Another communication passage 46 is formed in the front side block 8 to communicate the discharge pressure chamber 19 with a radially inner end of each of the vane slits 14, as shown in FIG. 5. One end of the communication passage 46 opens into the discharge pressure chamber 19 and the other end communicates with a plurality of, e.g. three, back-pressure ports 47, 47, 47 with a small diameter of 0.5 mm for instance, formed in the front side block 8 at circumferentially equal intervals and opening into the annular recess 22 at predetermined locations radially corresponding to back pressure chambers 14*a* formed at radially inner ends of respective vanes slits 14 in the rotor 10. On the other hand, a second cut-out portion 48 is formed in an inner peripheral edge of the control element 24, which is so located that as the first cut-out portions 25, 25 of the control element 24 are circumferentially displaced to increase the opening angle of the second inlet ports 23, 23, the second cut-out portion 48 is correspondingly displaced to successively open the back-pressure ports 47, 47, 47 to thus vary the total opening area of the back-pressure ports 47, 47, 47, i.e. the total amount of discharge pressure to be supplied as back pressure to the radially inner end faces of the vanes $15_1$–$15_4$ in the back pressure chambers 14*a*.

Figure 8:
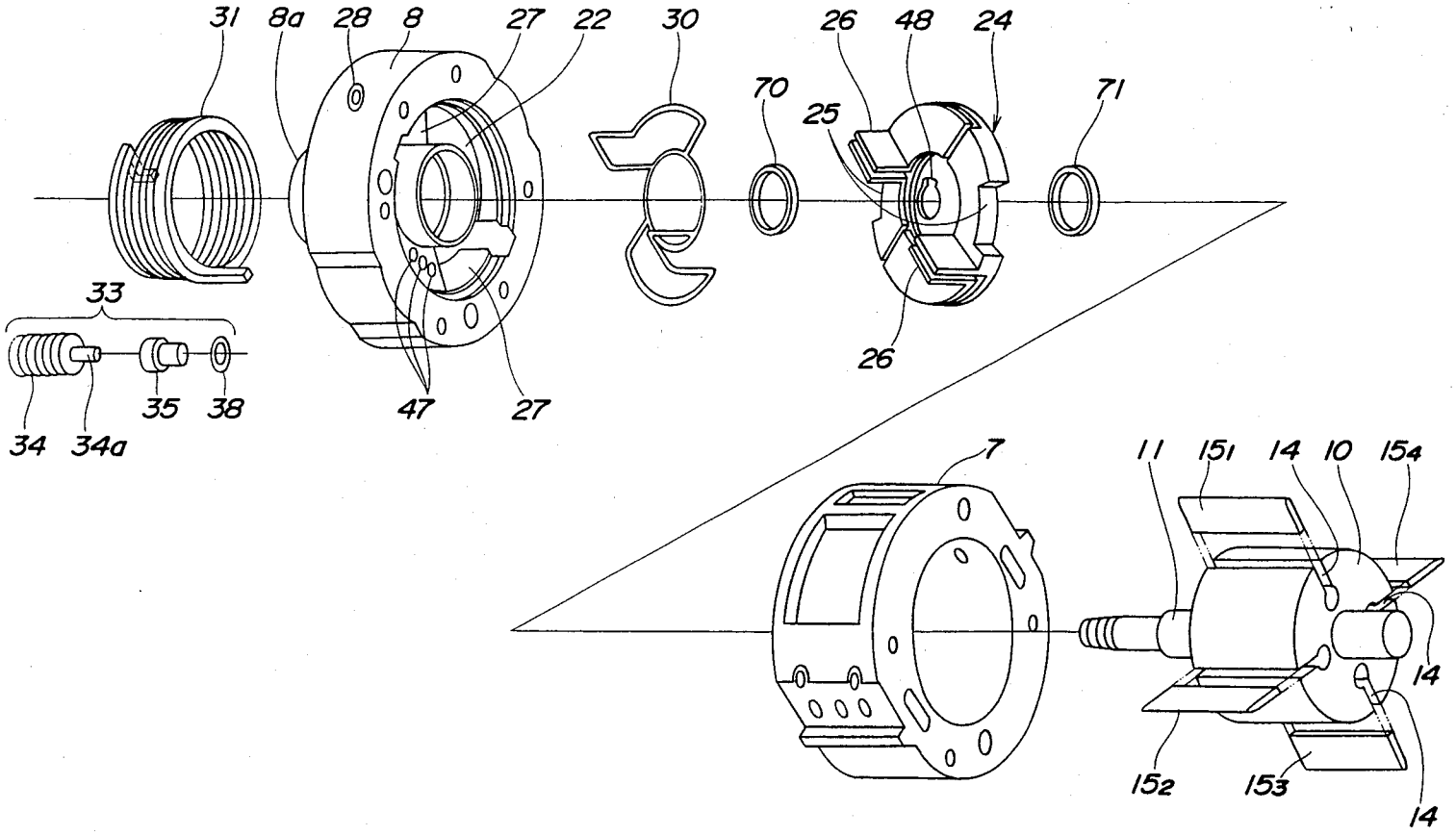
FIG. 8 is an exploded perspective view showing essential parts of the vane compressor of FIG. 1.
Figure 10:
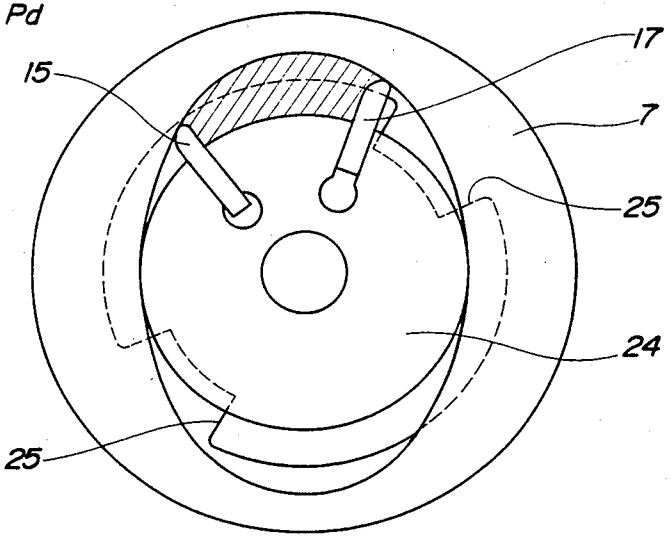
FIG. 10 is a transverse sectional view taken along line X—X in FIG. 1, showing the circumferential position of a control element 24 at full capacity operation of the vane compressor.

A sealing member 30 of a special configuration as shown in FIG. 8 is mounted on the control element 24 and disposed along an end face of its central portion and radially opposite end faces of each pressure-receiving protuberance 26, to seal in an airtight manner between the first and second pressure chambers $27_1$ and $27_2$, as well as between the end face of the central portion of the control element 24 and the inner peripheral edge of the annular recess 22 of the front side block 8, as shown in FIG. 1.

The control element 24 is elastically urged in such a circumferential direction as to increase the opening angle of the second inlet ports 23, i.e. in the direction indicated by the arrow B in FIG. 5, by a coiled spring 31 fitted around a central boss 8*a* of the front side block 8 axially extending toward the suction chamber 17, with its one end engaged by the central boss 8*a* and the other end by the control element 24, respectively.

Figure 3:
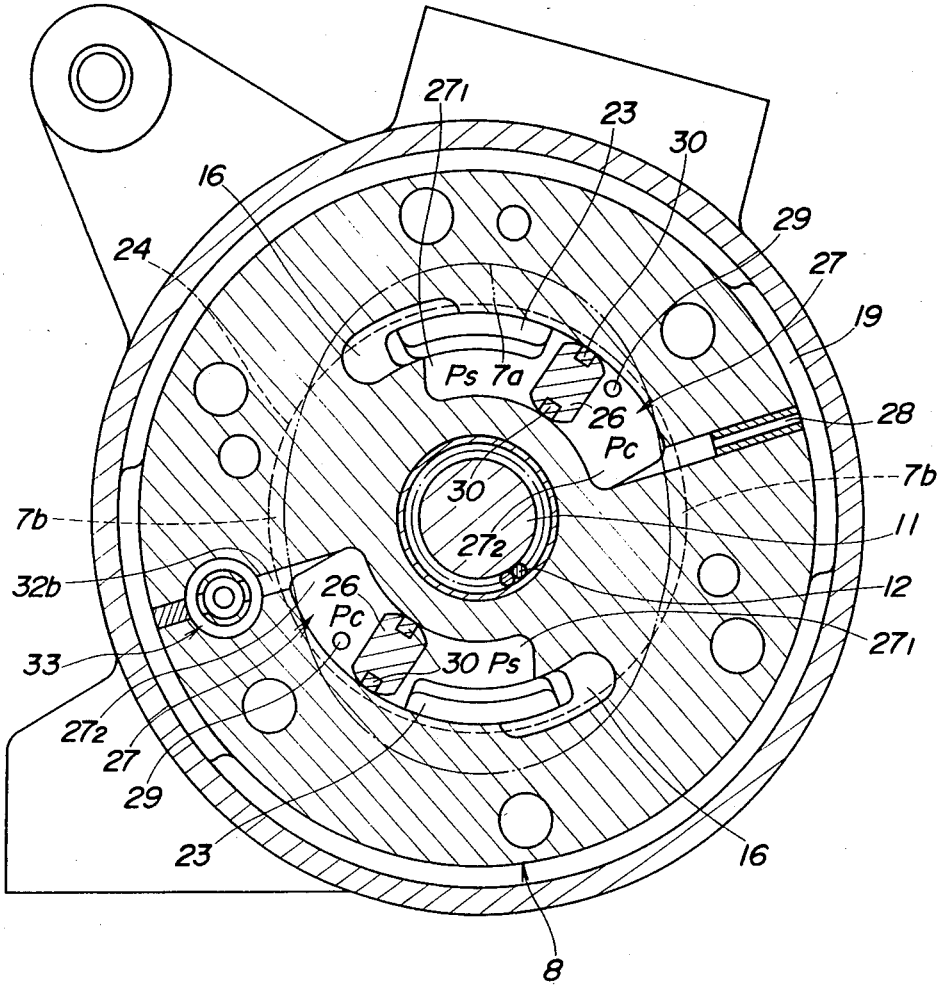
FIG. 3 is a transverse sectional view taken along line III—III in FIG. 1.
Figure 4:
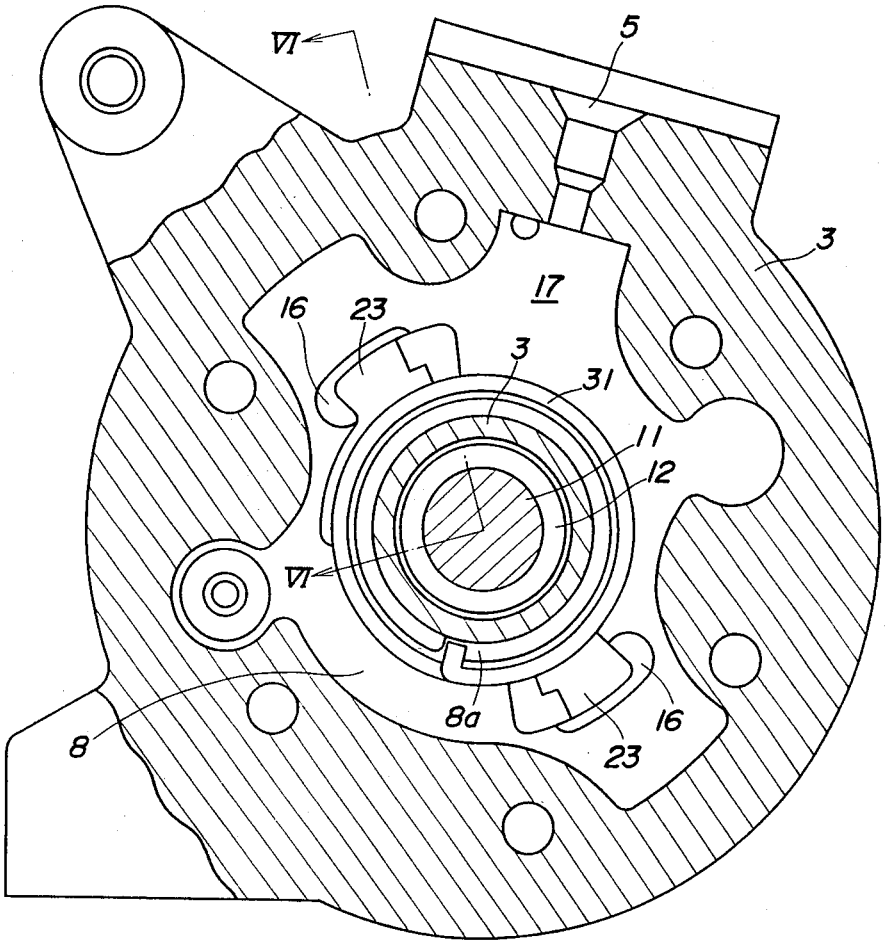
FIG. 4 is a transverse sectional view taken along line IV—IV in FIG. 1.

The second pressure chamber $27_2$ is communicated with the suction chamber 17 by way of communication passages 32*a* and 32*b* formed in the front side block 8, as shown in FIGS. 1 and 3. Arranged across these communication passages 32*a*, 32*b* is a control valve device 33 for selectively closing and opening them, as shown e.g. in FIG. 1. The control valve device 33 is operable in response to pressure within the suction chamber 17. As shown in FIGS. 1 and 8 it comprises a flexible bellows 34 disposed in the suction chamber 17, a valve casing 35 disposed in a recess 17*a* continuous with the suction chamber 17, a ball valve 36, and a coiled spring 37 urging the ball valve 36 in its closing direction. When the suction pressure within the suction chamber 17 is above a predetermined value, the bellows 34 is in a contracted state so that the ball valve 36 is biased to close the communication passage 32 by the force of the spring 37. When the suction pressure is below the predetermined value, the bellows 34 is in an expanded state to urgingly bias the ball valve 36 through its tip rod 34*a* to open the communication passage 32 against the force of the spring 37. An O-ring 38 is interposed between the valve casing 35 and the recess 17*a* in the front side block 8.

On the other hand, a magnet clutch 40 as power transmitting means is mounted on a front end of the driving shaft 11 by means of a hub 41, which comprises an armature plate 42 secured on the front end of the driving shaft 11, a pulley 43 rotatably supported by a boss of the front head 3 via a radial ball bearing, and a clutch coil 44 fixed to a front end face of the front head 3.

The operation of the vane compressor constructed as above will now be explained.

As the pulley 43 of the magnet clutch 40 is rotatively driven by a prime mover such as an automotive engine to cause clockwise rotation of the rotor 10 as viewed in FIG. 2 through the magnet clutch 40, the rotor 10 rotates so that the vanes $15_1$–$15_4$ successively move radially out of the respective slits 14 due to a centrifugal force and back pressure acting upon the vanes and revolve together with the rotating rotor 10, with their tips in sliding contact with the inner peripheral surface 7*a* of the cam ring 7. During the suction stroke each compression chamber 13*a*, 13*c* defined by adjacent vanes increases in volume so that refrigerant gas as thermal medium is drawn through the refrigerant inlet port 16 into the compression chamber 13*a*, 13*c*; during the following compression stroke the compression chanber 13*b*, 13*d* decreases in volume to cause the drawn refrigerant gas to be compressed; and during the discharge stroke at the end of the compression stroke the high pressure of the compressed gas forces the discharge valve 20 to open to allow the compressed refrigerant gas to be discharged through the refrigerant outlet port 18 into the discharge pressure chamber 19 and then discharged through the discharge port 4 into a heat exchange circuit of an associated air conditioning system, not shown.

During the operation of the compressor described above, low pressure or suction pressure within the suction chamber 17 is introduced into the first pressure chamber $27_1$ of each space 27 through the refrigerant inlet port 16, whereas high pressure or discharge pressure within the discharge pressure chamber 19 is introduced into the second pressure chamber $27_2$ of each space 27 through the restriction passage 28 or through both the restriction passage 28 and the communication passage 29. The control element 24 is circumferentially displaced depending upon the difference between the sum S of the pressure Ps within the first pressure chamber $27_1$ and the biasing force of the coiled spring 31 (which acts upon the control element 24 in the direction of the opening angle of each second inlet port 23 being increased as indicated by the arrow B in FIG. 5) and the pressure Pc within the second pressure chamber $27_2$ (which acts upon the control element 24 in the direction of the above opening angle being decreased as indicated by the arrow A in FIG. 5), to vary the opening angle of each second inlet port 23 and accordingly vary the timing of commencement of the compression stroke and hence the delivery quantity. When the above pressure difference is zero, i.e. when the pressure sum S is balanced with the pressure Pc in the second chamber $27_2$, the circumferential displacement of the control element 24 ceases.

Figure 9:
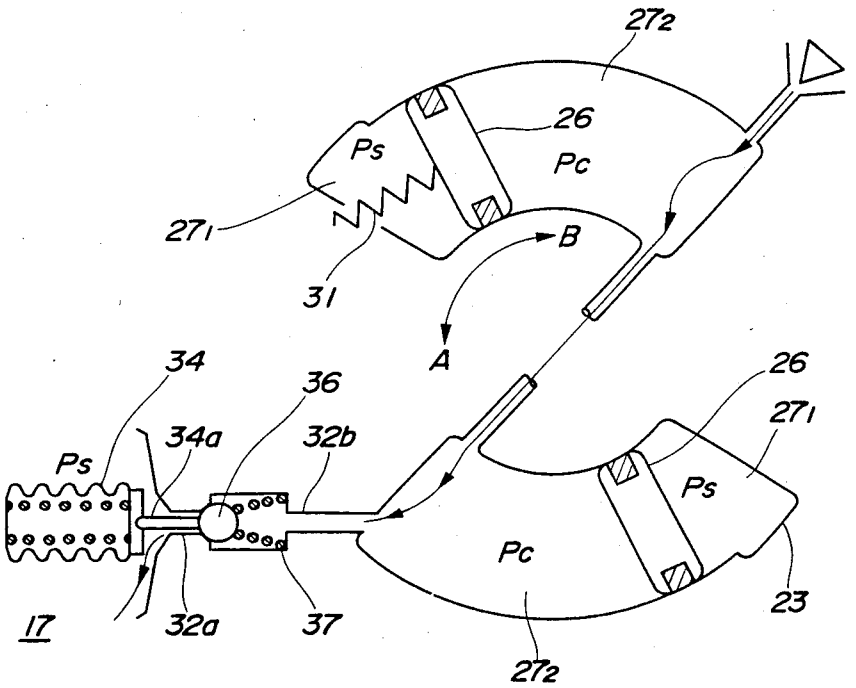
FIG. 9 is a diagrammatic view useful in explaining the balance in pressure between first and second pressure chambers $27_1$, $27_2$ at full capacity operation of the vane compressor.

More specifically, as shown in FIG. 9, when the compressor is operating at a low speed, the refrigerant gas pressure Ps or suction pressure within the suction chamber 17 is so high that the bellows 34 of the control valve device 33 is contracted to bias the ball valve 36 to block the communication passage 32*a*. Accordingly, the pressure Pc within the second pressure chamber $27_2$ surpasses the sum of the pressure Ps within the first pressure chamber $27_1$ and the biasing force of the coiled spring 31 (acting in the direction indicated by the arrow B in FIG. 9) so that the control element 24 is circumferentially displaced into an extreme position in the direction indicated by the arrow A in FIG. 9, whereby the second inlet port 23, 23 is fully closed by the control element 24 as shown in FIG. 9 (the opening angle is zero). Consequently, all the refrigerant gas drawn through the refrigerant inlet port 16 into the compression chamber 13*a*, 13*c* on the suction stroke is compressed and discharged, resulting in the maximum delivery quantity, as indicated by hatched portion in FIG. 10 (Full Capacity Operation).

On this occasion, the control element 24 closes all the back-pressure ports 47, 47, 47 so that discharge pressure from the discharge pressure chamber 19 is supplied as back pressure to the vanes $15_1$–$15_4$ only through the clearances between the side blocks 8, 9 and the rotor 10.

Figure 12:
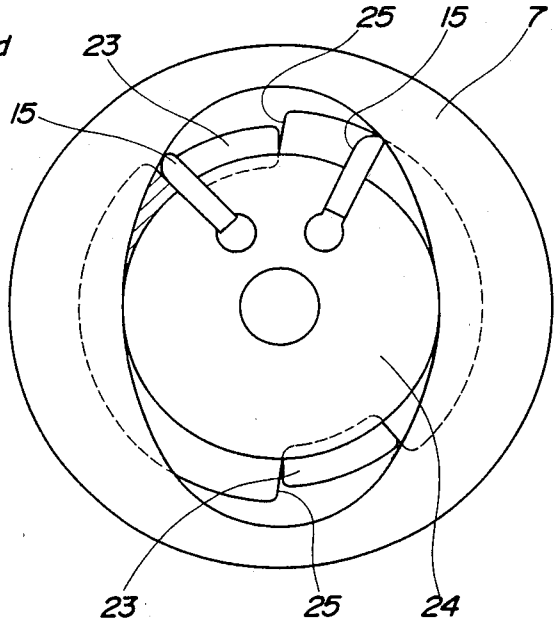
FIG. 12 is view similar to FIG. 10, at partial capacity operation of the vane compressor.
Figure 11:
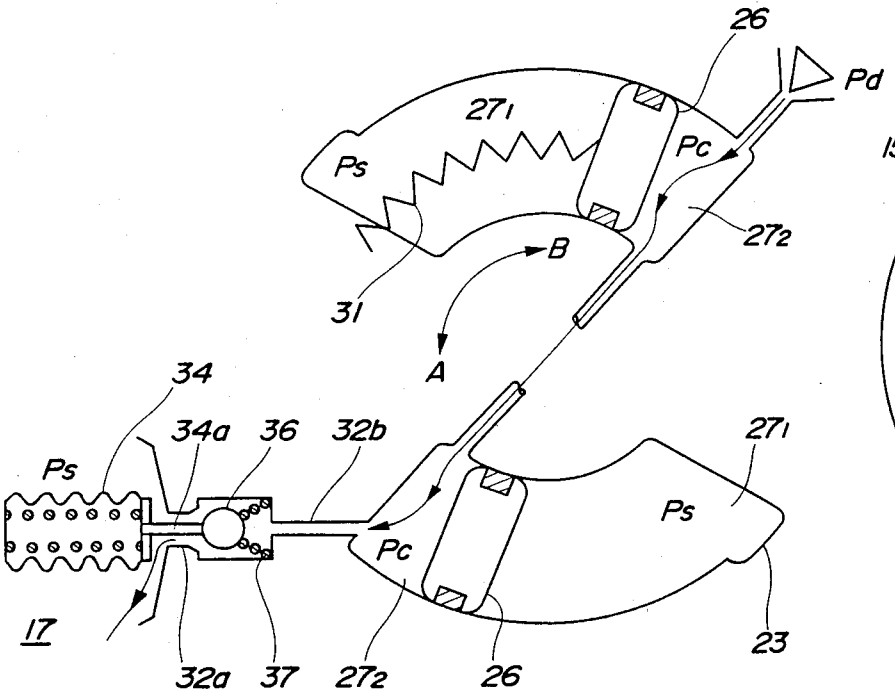
FIG. 11 is a view similar to FIG. 9, at partial capacity operation of the vane compressor.

On the other hand, when the compressor is operating at a high speed, the suction pressure Ps within the suction chamber 17 is so low that the bellows 34 of the control valve 33 is expanded to urgingly bias the ball valve 36 through its rod 34*a* to open the communication passage 32*a* against the force of the spring 37 to a degree corresponding to the suction pressure. Accordingly, the pressure Pc within the second pressure chamber $27_2$ leaks through the communication passageway 32*a*, 32*b* into the suction chamber 17 in which low or suction pressure prevails to cause a drop in the pressure Pc within the second pressure chamber $27_2$. As a result, the control element 24 is angularly or circumferentially displaced in the direction indicated by the arrow B in FIG. 11. As shown in FIG. 12, when the cut-out portion 25, 25 of the control element 24 becomes aligned with the respective second inlet port 23, 23 to open the latter, as indicated by solid lines in FIGS. 5 and 12, refrigerant gas in the suction chamber 17 is drawn into the compression chamber 13*a*, 13*c* not only through the refrigerant inlet port 16, 16 but also through the second inlet port 23, 23. Therefore, the timing of commencement of the compression stroke is retarded, or the compression stroke period is reduced by an amount corresponding to the degree to which the second inlet port 23 is opened, resulting in a reduced amount of refrigerant gas that is compressed and hence a reduced delivery quantity, as indicated by the hatched portion in FIG. 12 (Partial Capacity Operation).

The opening angle of the second inlet ports 23, 23 is controlled to a value where the sum of the pressure force Ps within the first pressure chamber $27_1$ and the force of the coiled spring 31 balances with the pressure force Pc within the second pressure chamber $27_2$. The circumferential position of the control element 24 varies in a continuous manner in response to change in the suction pressure within the suction chamber 17. Thus, the delivery quantity or capacity of the compressor is controlled to vary in a continuous manner.

As noted above, during the partial capacity operation, as the opening angle of the second inlet ports 23, 23 becomes larger, the back-pressure ports 47, 47, 47 become successively opened by the second cut-out portion 48 of the control element 24. That is, the total opening area of the back-pressure ports 47, 47, 47 increases so that discharge pressure is supplied to the inner end faces of the vanes at an increased rate corresponding to a drop in the discharge pressure within the discharge pressure chamber 19 which is caused by a decrease in the compression stroke period caused by the increased opening angle of the second inlet ports 23, 23, thereby preventing lowering of the back pressure acting upon the vanes $15_1$–$15_4$ even though the discharge pressure drops. As a result, the back pressure acting upon the vanes is maintained constant to cause the vanes to apply a constant urging force to the inner peripheral surface of the cam ring 7, irrespective of a change in the capacity of the compressor. Furthermore, the increased total opening area of the back-pressure ports 47, 47, 47 is effective to supply a sufficient quantity of lubricating oil to clearances between the side blocks 8, 9 and the rotor 10 during high speed operation of the compressor when the partial capacity operation takes place.

Although in the first embodiment described above the back-pressure ports 47, 47, 47 for supplying back pressure from the discharge pressure chamber 19 to the inner end faces of the vanes $15_1$–$15_4$ are provided at a single point of the front side block 8, and the second cut-out portion 48 for closing and opening the back-pressure ports 47, 47, 47 is provided at a single point of the control element 24, this is not limitative to the invention, but two groups of such back-pressure ports may be provided at two points of the front side block 8, e.g. at diametrically opposite locations, and two such second cut-out portions may be provided at two points of the control element 24 for closing and opening the two groups of back-pressure ports.

Figure 22:
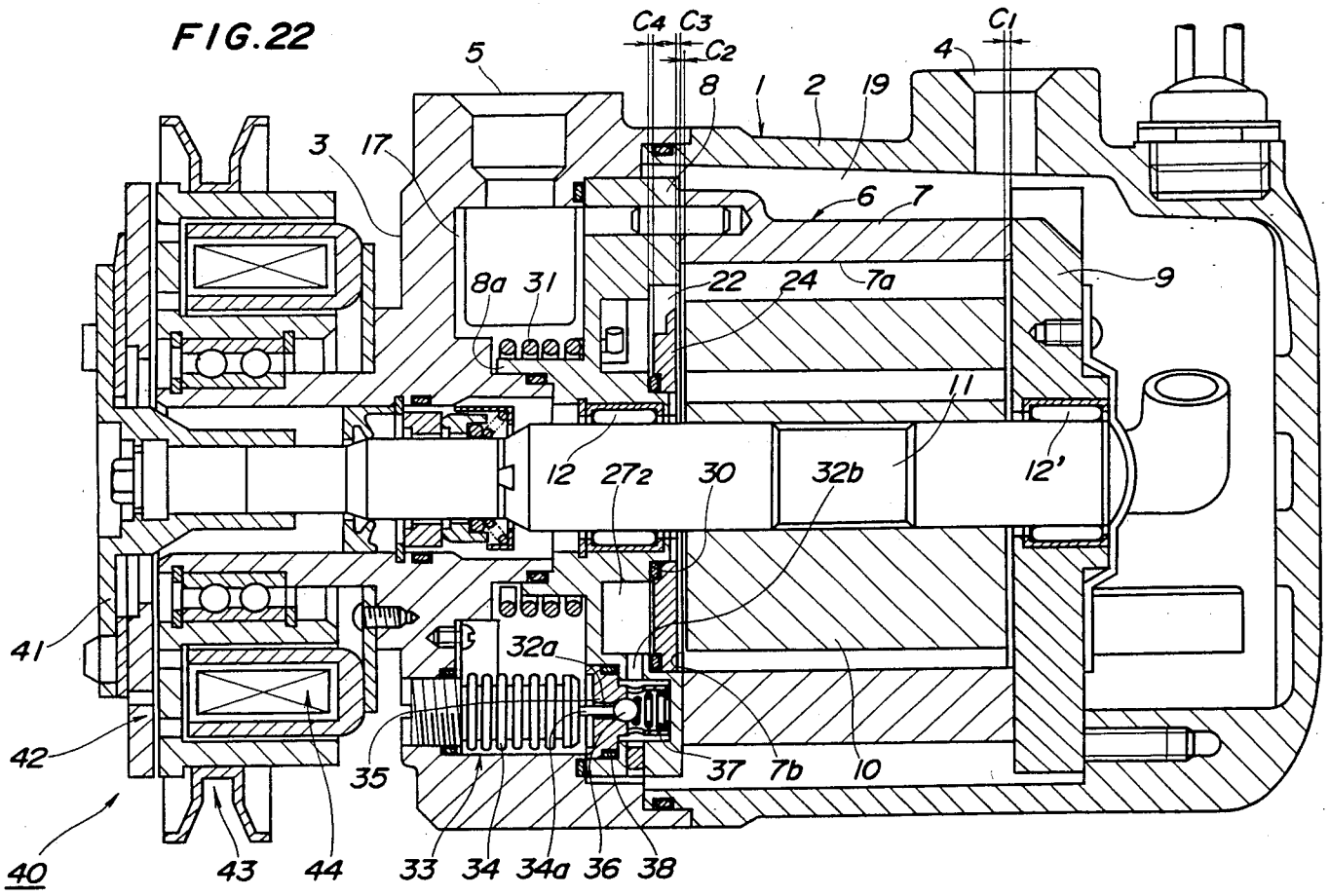
FIG. 22 is a view similar to FIG. 1, showing a variable capacity vane compressor in which clearances between component parts are set in a conventional manner.

Generally, in a vane compressor constructed as above, as shown in FIG. 22 for example, clearances C1 and C2 are provided, respectively, between an end face of the rotor 10 and an opposed end face of the rear side block 9 and between the opposite end face of the rotor 10 and an opposed end face of the front side block 8 so as to permit smooth rotation of the rotor 10 received within the cam ring 7 whose opposite ends are closed, respectively, by the front side block 8 and the rear side block 9. These clearances C1 and C2 are set at such values as to compensate for errors in the sizes of the cam ring 7 and the rotor 10, deformation of the cam ring 7 caused as the cam ring is compressed by the side blocks 8, 9 when the latter is fastened to the former, deformation of the cam ring 7 and the side blocks 8, 9 caused by the pressure of the refrigerant within the cylinder, etc.

Further, since the cam ring of the vane compressor has an ellipsoidal camming inner peripheral surface, the control element 24 is held between a bottom face of the annular recess 22 in the front side block 8 and the opposed end face of the cam ring 7 at diametrically opposite portions where the cam ring 7 has the smallest inside diameter (FIG. 3). To enable smooth rotation of the control element 24, there are provided a clearance C3 between the control element 24 and the diametrically opposite portions of the end face of the cam ring 7 with the smallest inside diameter and a clearance C4 between the control element 24 and the bottom face of the annular recess 24, in addition to the above mentioned clearances C1 and C2.

However, because of so many clearances C1 through C5 provided in the variable capacity vane compressor, the clearance between the opposed end faces of the control element 24 and the rotor 10 is so large (=C2+C3) that the amount of refrigerant leaking into the suction chamber 17 from the cylinder via the clearances C2+C3 and the second inlet ports 23 can be excessive, which results in a greater driving force required to rotate the rotor 10 and consequently unnecessary heat generation of sliding parts of the compressor to cause an increase in the discharge refrigerant temperature.

The present invention has solved this problem, as shown in FIG. 1 of the first embodiment, by designing the cam ring 7 and the rotor 10 such that their end faces facing toward the suction chamber 17 are axially flush with each other, with clearances C1, C4, and C5 existing, respectively, between the opposed end faces of the rotor 10 and the rear side block 9, between the end face of the control element 24 and the opposed bottom face of the recess 22 and between the opposed end faces of the control element 24 and the rotor 10. The clearance C5 is the minimum clearance set at a value equal to the larger one of the clearance C2, required for smooth rotation of the rotor 10 and the clearance C3 required for smooth rotation of the control element 24, i.e. C5=C2, or C5<C2+C3.

Therefore, in the present invention, the clearance C5 performs both of the functions of the conventional clearances C2 and C3, shown in FIG. 22, thus contributing to decrease of the clearance required for smooth rotation of the control element 24, and hence minimizing the leakage of the refrigerant whereby the rotor driving force can be small and the discharge refrigerant temperature can be lowered.

Figure 13:
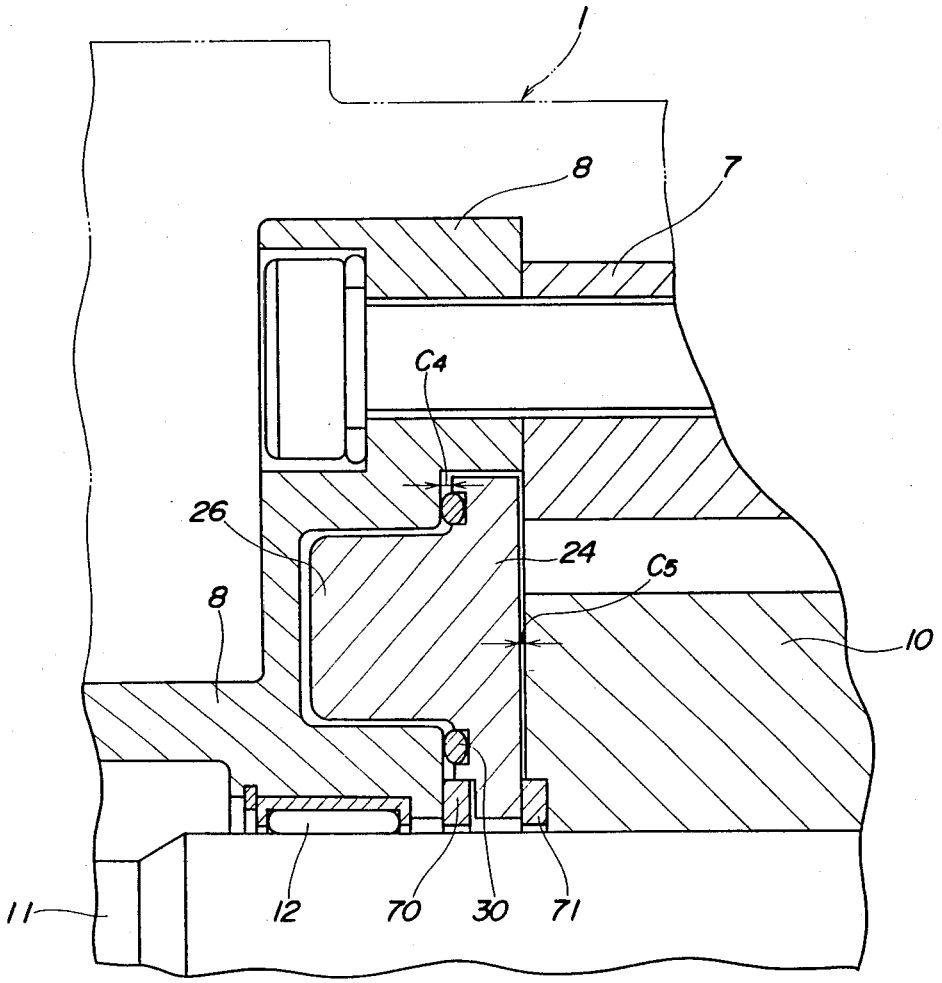
FIG. 13 is a fragmentary longitudinal sectional view on an enlarged scale, showing an essential part of FIG. 1.

Further, according to the invention, in order to assure that the minimum clearances C5 and C4 are maintained, as best shown in FIG. 13, spacer means (shims) 70, 71 are provided for the purpose of maintaining a predetermined minimum clearance between the control element 24 and the side block 8 having the second suction port 23 and a predetermined minimum clearance between the control element 24 and the rotor 10 at respective predetermined values.

To be specific, the shims 70, 71 are provided, respectively, between the control element 24 and the front side block 8 and between the control element 24 and the rotor 10 in such a manner that the minimum clearances C4 and C5 therebetween are maintained at the respective predetermined values even when the control element 24 is axially displaced along the driving shaft 11, rightward or leftward as viewed in FIG. 13. The minimum clearance values are set at values within a range of 1–10 microns, for example, and preferably about 5 microns. As shown in FIG. 13, the control element 24 is axially movable between the front side block 8 (exactly speaking, the bottom face of the recess 22) and the rotor 10 through the maximum stroke, preferably 35 microns. Therefore, the clearances between the control element 24 and the bottom face of the recess 22 and between the control element and the rotor 10 each vary, preferably from 5 to 35 microns with axial movement of the control element 24.

As the pressure in the second chamber $27_2$ of the arcuate space 27 rises above the vane back pressure during the full capacity operation of the compressor, the control element 24 is displaced toward the rotor 10 by the former pressure. Even then, the shim 71 maintains the predetermined minimum clearance C5 of 5 microns for instance between the control element 24 and the rotor 10, thus ensuring smooth rotation of the control element 24. In other words, the frictional resistance between the control element 24 and the rotor 10 is then made very small by the shim 71 to allow the control element 24 to be smoothly rotated with high responsiveness to the difference between pressures in the chambers $27_1$ and $27_2$.

Also, when the compressor is switched to partial capacity operation, the vane back pressure becomes higher than the pressure in the second chamber $27_2$ of the arcuate space 27 whereby the control element 24 is displaced toward the front side block 8, but by virtue of the shim 70 the predetermined minimum clearance C4 of 5 microns for instance is maintained between the control element 24 and the front side block 8, to thereby secure smooth movement of the control element 24 and thus permit smooth changeover to partial capacity operation.

During full capacity operation of the compressor, the control element 24 is displaced toward the rotor 10 and then the clearance between the control element 24 and the rotor 10 assumes the minimum value C5 (e.g. 5 microns) and thus the leakage amount of compressed refrigerant as well as that of the vane back pressure become smaller, to enhance the compression efficiency of the compressor. On the other hand, during partial load operation, the control element 24 is displaced toward the bottom face of the recess 22 in the front side block 8 so that the clearance therebetween assumes the minimum value C4 (e.g. 5 microns) and thus the leakage amount of compressed refrigerant and that of the vane back pressure are increased to reduce the compression effeciency of the compressor.

If this embodiment is applied to a compressor constructed such that the pressure in the second chamber $27_2$ of the arcuate space 27 is always higher than the vane back pressure, the control element 24 in such compressor is never urged toward the front side block 8, and then the shim 71 alone suffices. Inversely, if the compressor applied is constructed such that the pressure in the second chamber $27_2$ of the arcuate space 27 is always lower than the vane back pressure, it suffices to provide the shim 70 only.

By virtue of the shims 70, 71 a clearance of a predetermined minimum size is always secured on the side of the control element 24 toward which the control element 24 is urged by the pressure of refrigerant gas, the control element 24 can always rotate smoothly and thus the control reliability is further improved.

Figure 14:
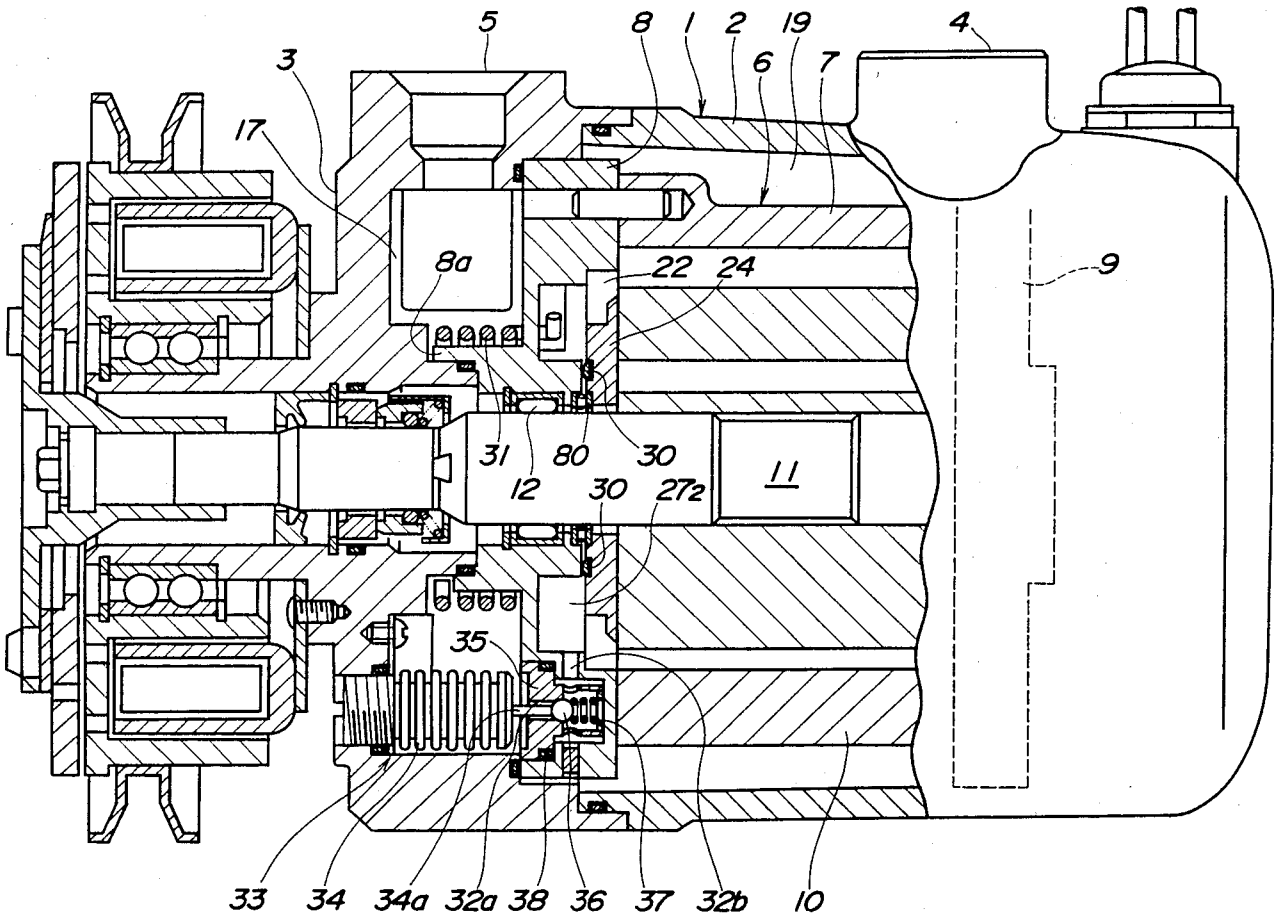
FIG. 14 is a view similar to FIG. 1, showing another variation of the first embodiment of FIG. 1.

The shims 70, 71 may be superseded by one or two roller bearings, preferably needle bearings to secure the predetermined clearances, as shown in FIG. 14 showing only one needle bearing 80 interposed between the control element 24 and the front side block 8. Then, the smoothness of rotation of the control element 24 will still more be improved, further enhancing the control reliability. Alternatively, needle bearings may be arranged adjacent respective shims 70, 71.

Further, instead of providing the shims or needle bearings as the spacer elements, at least one of the control element 24, the front side block 8, and the rotor 10 may be formed integrally with a protuberance.

Figure 15:
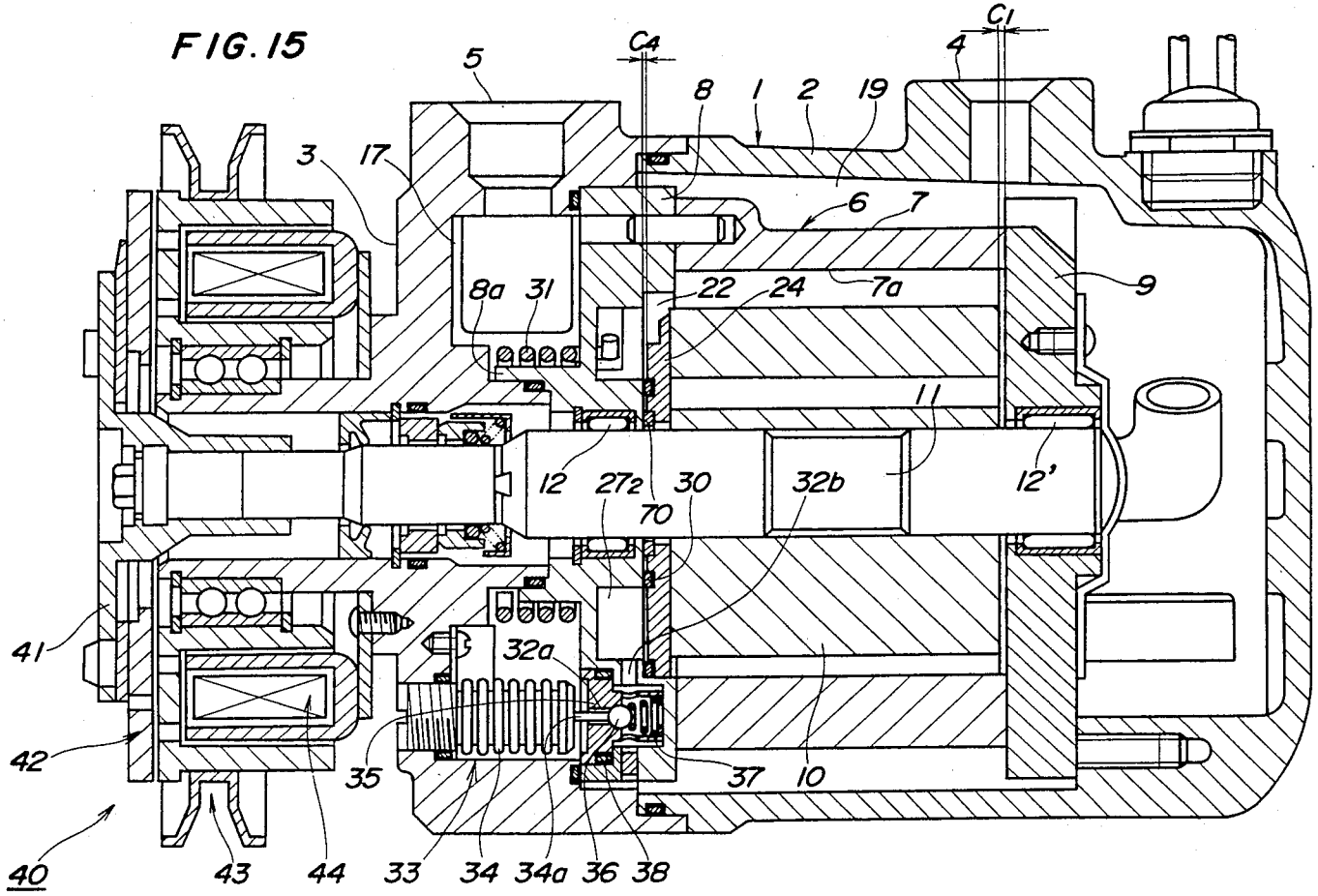
FIG. 15 is a view similar to FIG. 1, showing a variation of the first embodiment of the invention.

FIG. 15 shows a variation of the first embodiment of the invention, which is distinguished from the first embodiment where the end faces of the cam ring 7 and the rotor 10 facing toward the suction chamber 17 are axially flush with each other, in that no clearance corresponding to the clearance 5 in FIG. 1 exists between the annular control element 24 and the rotor 10 since the end face of the rotor 10 facing toward the suction chamber 17 is slightly inserted into the recess 22 in the front side block 8.

According to the FIG. 15 arrangement, even though the clearance C5 does not exist, the resiliency of the sealing member 30 allows the control element 24 to move in the axial direction to permit smooth rotation of the rotor 10 and the control element 24.

Figure 16:
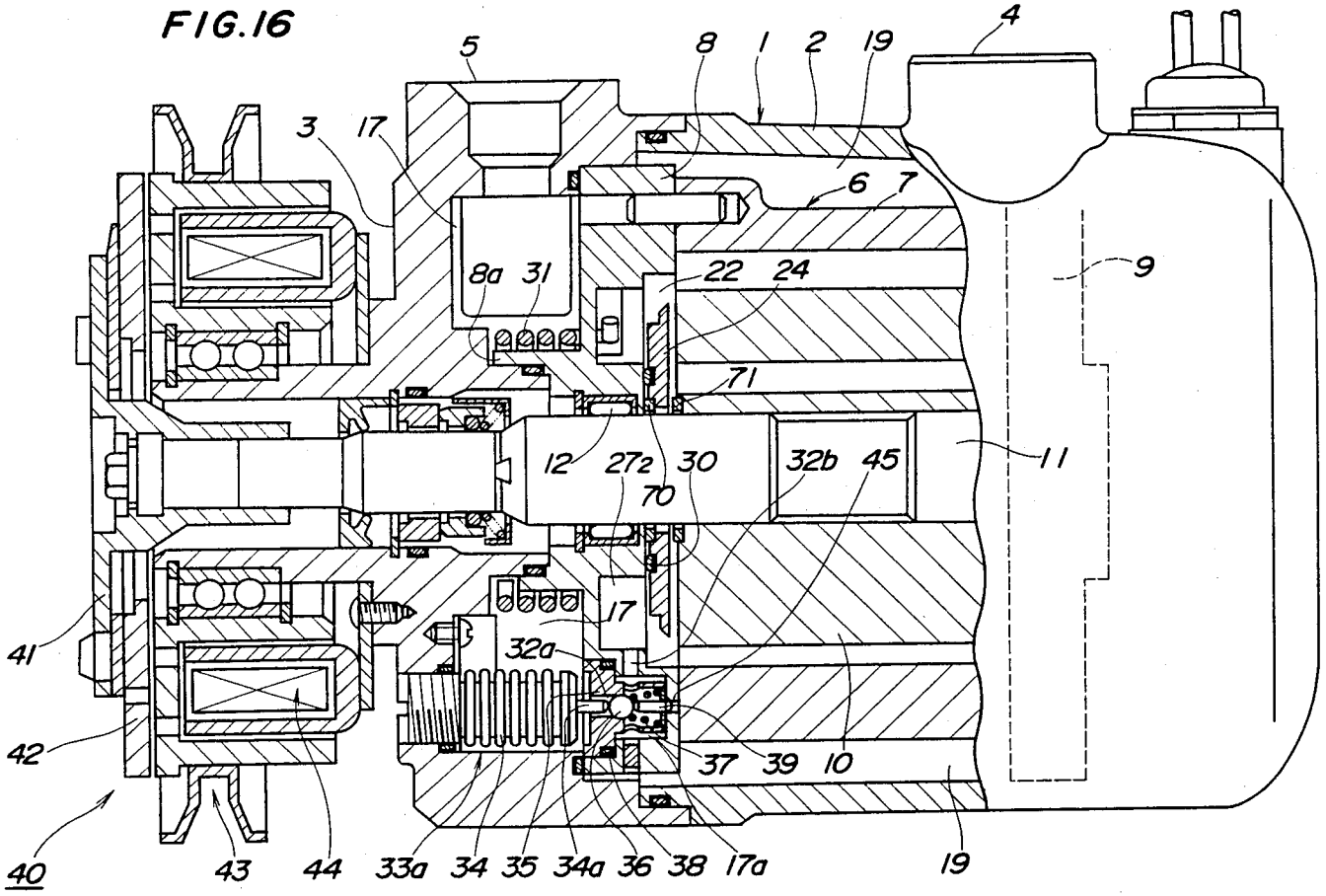
FIG. 16 is a view similar to FIG. 1, showing a second embodiment of the invention.
Figure 17:
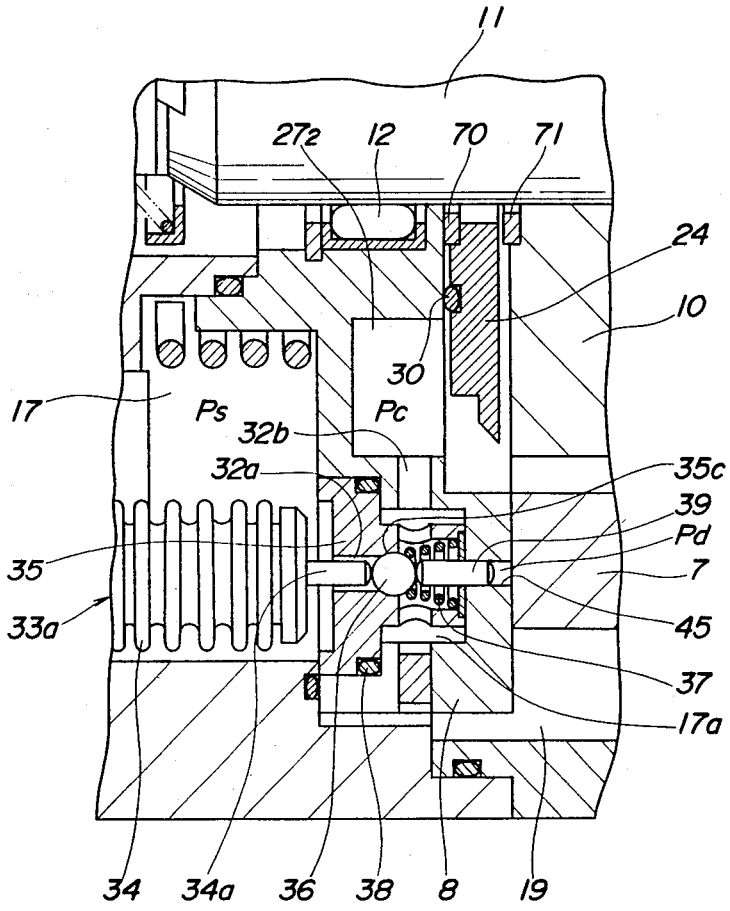
FIG. 17 is a fragmentary longitudinal sectional view on an enlarged scale, showing an essential part of FIG. 6.

FIGS. 16 and 17 show a second embodiment of the invention. The second embodiment is distinguished from the first embodiment in that a hysteresis-prevention means (comprising a through bore 45 and a plunger 39 fitted therein) is provided in the control valve device 33 for eliminating a hysteresis in the operation of the device 23. In the second embodiment, as best shown in FIG. 17, a control valve device **33*a* corresponding to the control valve device 33 in FIG. 1 comprises a flexible bellows 34, a casing 35, a ball valve 36, and a coiled spring 37 urging the ball valve 36 in its closing direction, and the plunger 39. The plunger 39, which acts to eliminate a hysteresis in the operation of the control valve device 33*a* to thereby facilitate smooth valve operation, is slidably inserted in the through bore 45 formed through the front side block 8 and extending between a recess 17*a* accommodating the casing 35 and the end face of the front side block 8 facing toward the cam ring 7. The through bore 45 is supplied with discharge pressure Pd from the discharge pressure chamber 19 via the clearance (not visible) between the front side block 8 and the cam ring 7 so that the plunger 39 is always urged by the discharge pressure Pd against the ball valve 36 with its tip always in urging contact with the ball valve 36. It is so designed that the seating area S of the ball valve 36 in contact with an opposed end edge of a communication passage 32*a* is almost as large as the area S' (pressure-receiving area) of the end face of the plunger 39 remote from the ball valve 36. When the pressure Ps (from the lower pressure chamber) is higher than a predetermined value, the bellows 34 is in a contracted state whereby the ball valve 36 is biased by the combined forces of the spring 37 and the plunger 39 to close the communication passage 32*a*. On the other hand, when the pressure Ps from the suction chamber 17 is lower than the predetermined value, the bellows 34 is in an expanded state whereby the rod 34*a* at the end thereof urgingly biases the ball valve 36 against the combined forces of the spring 37 and the plunger 39 to open the communication passage 32*a***.

Referring next to FIG. 17, how the plunger 39 of the control valve device **33*a* operates to eliminate the hysteresis will be described. First, let it be assumed that the plunger 39 is not provided. Then, the ball valve 36 would be acted upon by the sum of the forces of the spring 37 and the pressure Pc (3.0–14.0 kg/cm$^2$) prevailing in the second pressure chamber $27_2$ of the pressure chamber 27, in the direction of closing the control valve device 33*a*. Also, the ball valve 36 would be acted upon by the counteracting force of the bellows 34 when the latter is expanded, in the direction of opening the control valve device 33*a***.

It is desirable that the control valve device should be opened and closed substantially solely in response to the urging force from the suction chamber 17 (i.e. from the lower pressure chamber) alone and with high responsiveness.

When the bellows 34 is expanded to open the ball valve 36, there occurs a flow from the second pressure chamber $27_2$ to the suction chamber 17 through the open valve 36, since the discharge pressure Pd is supplied to the second presure chamber $27_2$ via the restriction passage 28 the pressure Pc inside the recess **17*a* is higher than the suction pressure Ps in the suction chamber 17. On this occasion, when the ball valve 36 is about to close, it receives at a portion of its surface facing the valve seat 35*c* a force represented by S X ΔP (where $\Delta P = Pc - Ps$, and S is the seating area of the ball valve 36) which is created by the flow passing through the narrow passage between the valve body 36 and the valve seat 35*c*, and urges the ball valve 36 in the valve opening direction (rightwardly as viewed in FIG. 17). Therefore, under the influence of the force represented by S X ΔP, the ball valve 36 is unable to promptly move into its closing position even when the bellows 34 is contracted. Once the ball valve 36 becomes closed following contraction of the bellows 34, the communication between the second pressure chamber $27_2$ and the suction chamber 17 is interrupted, whereby the pressure Pc in the chamber $27_2$ into which the discharge pressure Pd (e.g. 14 kg/cm$^2$) is introduced via the restriction passage 28, rises to a level as high as the discharge pressure Pd, so that a large force represented by S X ΔP' (where $\Delta P' = Pc - Ps$) acts on the ball valve 46 in the leftward direction as viewed in FIG. 17. Therefore, once the ball valve 36 assumes its closing position, it is unable to promptly move into its opening position even when the bellows 34** expands thereafter.

As a result, there occurs a hysteresis in the movement of the ball valve 36 between the opening position and closing position, resulting in degraded control accuracy.

To eliminate such hysteresis, the plunger 39 in the third embodiment acts to always apply a force of a fixed magnitude to the ball valve 36 in the closing direction.

To be specific, when the ball valve 36 is in the opening position, the pressure Pc in the second pressure chamber $27_2$ is diluted by the suction pressure Ps from the suction chamber 17 to become lower than Pd (Pc<Pd). On this occasion the pressure Pc acts on the left end face S' of the plunger 39 and the discharge pressure Pd acts on the right end face S' of the plunger 39. Therefore, the force F acting on the ball valve 36 is represented by the following equation.

$$F = S(Pc - Ps) + S'(Pd - Pc) \quad (1)$$

where S is the pressure-receiving area of the ball valve 36.

Supposing that the opposite end faces of the plunger 39 are equal in pressure-receiving area to each other (=S'), the Equation (1) can be replaced by the following equation (2):

$$F = S(Pd - Ps) \quad (2)$$

Equation (2) indicates that the ball valve 36 is always acted upon by the constant force $F[=S(Pd-Ps)]$, which is not a function of the pressure Pc, during its opening position. Thus, the ball valve 36 can be promptly and positively seated into the closing position without delay by the differential force Pd−Ps between the discharge pressure Pd and the suction pressure Ps, which acts upon the valve 36 via the plunger 39, and also by the force of the spring 37.

Once the valve is thus closed, the pressure Pc in the second pressure chamber cannot leak through the communication passage **32*a* and then rises up to a level equal to the discharge pressure Pd (Pc=Pd). This high pressure Pc acts upon the valve body 36** in the closing direction (leftwardly as viewed in FIG. 19). Therefore, the term S' (Pd−Pc) in the Equation (1) becomes zero.

That is, in spite of the existence of the plunger 39, the counteracting force of the plunger 39 which acts on the ball valve 36 as the latter moves from the closing position to the opening position is zero or negligible, so that the ball valve 36 can be brought into the opening position without delay as in the conventional valve control valve device.

As a result, the hysteresis that occurs in the displacement of the ball valve 36 between the opening position and the closing position can be eliminated, making it possible to set the valve opening and closing pressures of the control valve device only by selecting the spring constant of the spring 37.

Also, in the event that the discharge pressure Pd is higher than a normal value (e.g. 14 kg/cm$^2$), for example it is 20 kg/cm$^2$, that is, the capacity of the compressor is small, the ball valve 36 receives higher pressure from the plunger 39, so that the ball valve 36 does not open at the normal valve opening suction pressure (e.g. 2 kg/cm$^2$), but it opens only when the suction pressure Ps becomes equal to a value (e.g 1.7 kg/cm$^2$) lower than the normal value (e.g. 2 kg/cm$^2$). As a result, the movement of the control element 24 in the direction indicated by the arrow B (FIG. 5) is retarded, whereby the discharge capacity of the compressor becomes larger. In this way, high discharge pressure-dependent correction of the capacity is spontaneously carried out.

As described above, the provision of the plunger 39 makes it possible not only to eliminate the hystereis in the operation of the control valve device for improvement of the controllability, but also to enable spontaneous high discharge pressure-dependent correction of the capacity in the event that the discharge pressure is higher than the normal value.

Figure 18:
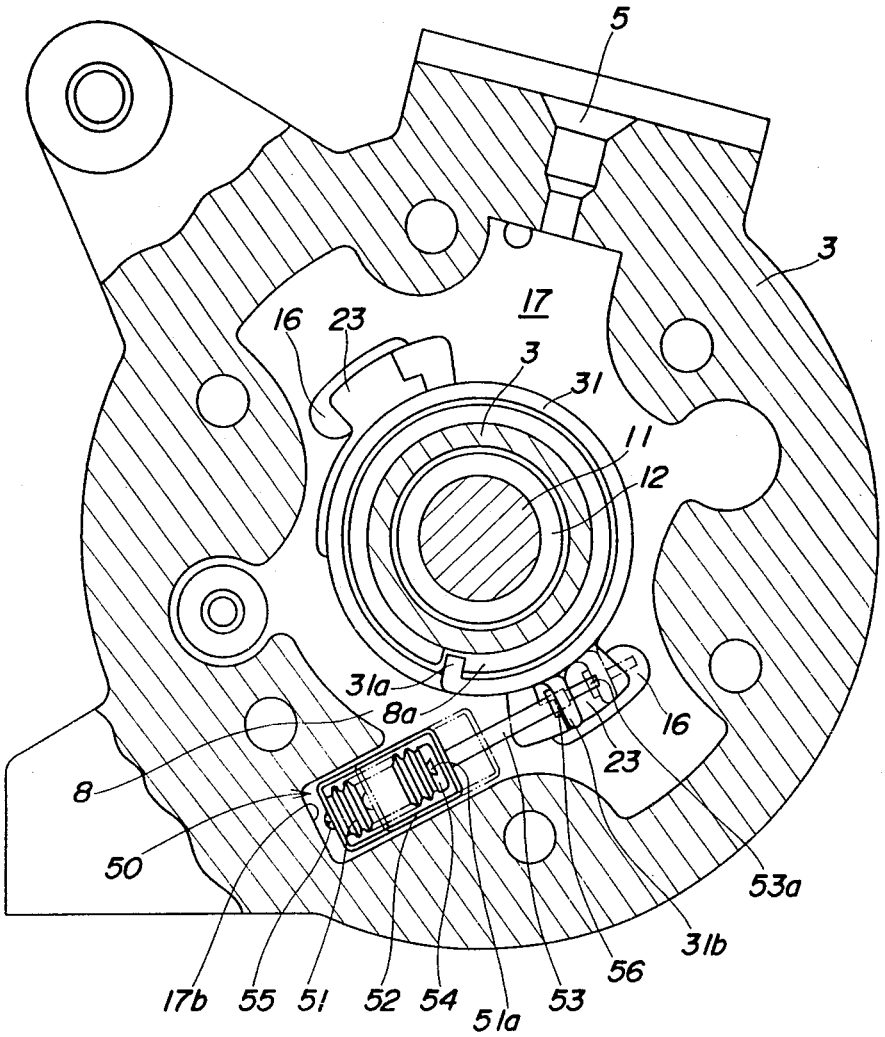
FIG. 18 is a view similar to FIG. 4, showing a third embodiment of the invention.
Figure 19:
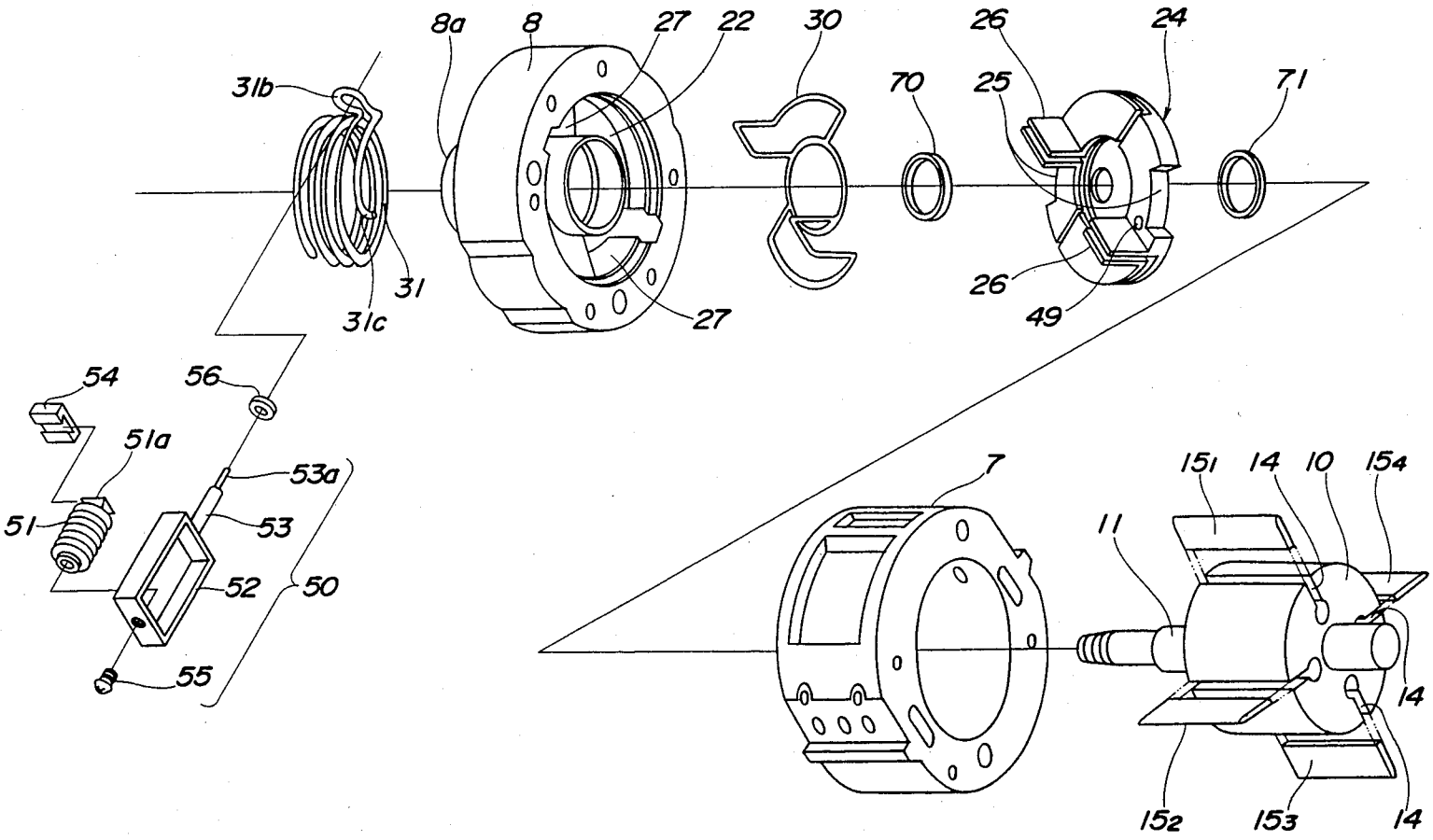
FIG. 19 is a view similar to FIG. 8, showing the third embodiment.

FIGS. 18 and 19 show a third embodiment of the invention. The third embodiment is distinguished from the first or FIG. 1 embodiment in that a capacity-increasing mechanism 50 is provided in the suction chamber 17 for rotating the control element 24 in the direction of reducing the opening angle of each second inlet port 23 when the pressure in the suction chamber 17 exceeds a predetermined value.

In the third embodiment, as in the first embodiment, the control element 24 is elastically urged in such a circumferential direction as to increase the opening angle of the second inlet ports 23, i.e. in the direction indicated by the arrow B in FIG. 5, by the biasing means or the coiled spring 31 fitted around the central boss 8*a* of the front side block 8 axially extending into the suction chamber 17. However, in the fourth embodiment, the coiled spring 31 has its one end 31*a* engaged by the central boss 8*a* and has a pressure-receiving looped portion 31*b* near the other end and a hook 31*c* at the other end. The pressure-receiving looped portion 31*b* is located in one of the second inlet ports 23 of the front side block 8, and the hook 31*c* is engaged in a hole 49 formed in the control element 24.

The capacity-increasing mechanism 50 is arranged in a recess 17*b* formed in the peripheral wall of the suction chamber 17, and comprises a bellows 51 expandable and contractable in response to the pressure (suction pressure) in the suction chamber 17, a movable frame 52 in which is housed the bellows 51, and a rod 53 having its one end secured to one end of the movable frame 52. The bellows 51 has its one end fixed in position in such a manner that a protuberance 51*a* formed at the one end engages with a stopper 54 protruding from the front head 3, and the other end is secured to the other end of the movable frame 52 by means of a screw 55. The rod 53 has the other end 53*a* with a reduced diameter fitted through the loop of the pressure-receiving looped portion 31*b* of the coiled spring 31, and a stepped shoulder between the reduced diameter other end and the thickened portion is held in urging contact with the pressure-receiving looped portion 31*b* via a washer 56 in such a manner that the rod 53 can urgingly deform the coiled spring 31. With this arrangement, when the suction pressure is higher than the normal value (e.g. 2 kg/cm$^2$), e.g. 3 kg/cm$^2$, the bellows 51 is contracted so that the movable frame 52 is upwardly rightwardly moved as viewed in FIG. 18, whereby the rod 53 urges the pressure-receiving looped portion 31*b* against the force of the coiled spring 31 to cause the control element 24 to rotate in the direction indicated by the arrow A in FIG. 5, and on the other hand, when the suction pressure is equal to or below the normal value (e.g. 2 kg/cm$^2$), the bellows 51 is expanded so that the movable frame 52 is downwardly leftwardly moved, whereby the control element 24 is rotated in the direction indicated by the arrow B in FIG. 5 by the force of the coiled spring 31.

Now, the operation of the capacity-increasing mechanism 50 constructed as above will be described. When the vane compressor has just started or immediately after it is switched to full capacity operation from partial capacity operation, the pressure Pc in the second pressure chamber 27$^2$ is so low that the control element 24 is biased in the direction indicated by the arrow B in FIG. 5 and accordingly the opening angle of the second inlet ports 23 is large. Without the capacity-increasing mechanism 50, therefore the discharge pressure would not promptly increase to a value required for rotating the control element 24 in the direction of effecting the full capacity operation (i.e. in the direction indicated by the arrow A), at the start of the compressor or at changeover from partial capacity operation to full capacity operation. The capacity-increasing mechanism 50 can solve this problem, and operates in response to the suction pressure which is higher when the compressor is started or switched to full capacity operation from partial capacity operation than it is operating in a normal steady condition, to rotate the control element 24 in the direction of effecting the full capacity operation upon sensing the increased suction pressure. More specifically, when the suction pressure exceeds a normal value, the bellows 51 is contracted to cause the movable frame 52 to move in the upward rightward direction in FIG. 18, whereby the rod 53 urgingly deforms the pressure-receiving looped portion 31*b* of the coiled spring 31 to cause the control element 24 to rotate in the direction indicated by the arrow A in FIG. 5, i.e. in the direction of effecting the full capacity operation. As a result, the opening angle of the second inlet ports 23 becomes smaller to cause a rapid increase in the delivery quantity or capacity.

As the compressor enters a normal operating condition, the suction pressure becomes lower, and accordingly the bellows 51 becomes expanded to move the movable frame 52 and the rod 53 in the downward leftward direction, whereby the control element 24 is rotated in the direction indicated by the arrow B in FIG. 5 urged by the force of the coiled spring 31 to assume its original position, whereafter the normal capacity control is effected. In this way, when the compressure is started or when it is switched to full capacity operation from partial capacity operation, the pressure required for effecting capacity control is quickly attained in the higher pressure chamber, enabling smooth compressor starting and changeover from partial capacity operation to full capacity operation.

Incidentally, the bellows 51 as the pressure-sensing element may be superseded by a Bourdon tube or the like.

Figure 20:
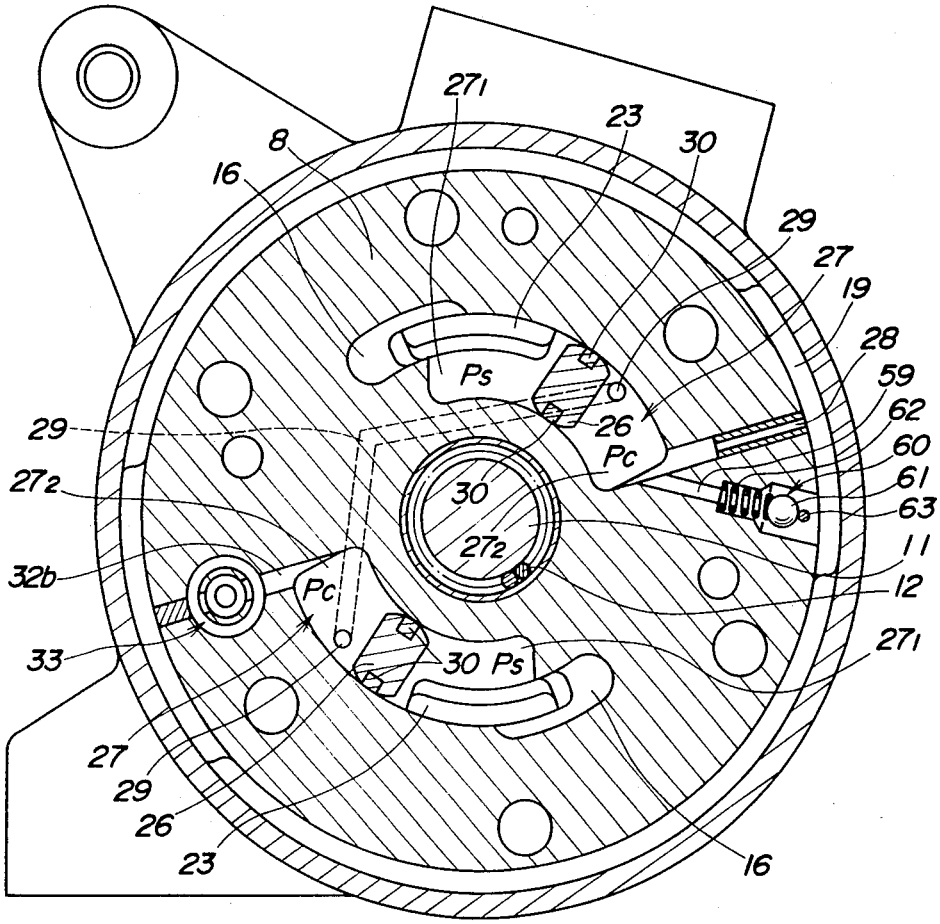
FIG. 20 is a view similar to FIG. 3, showing a fourth embodiment of the invention.
Figure 21:
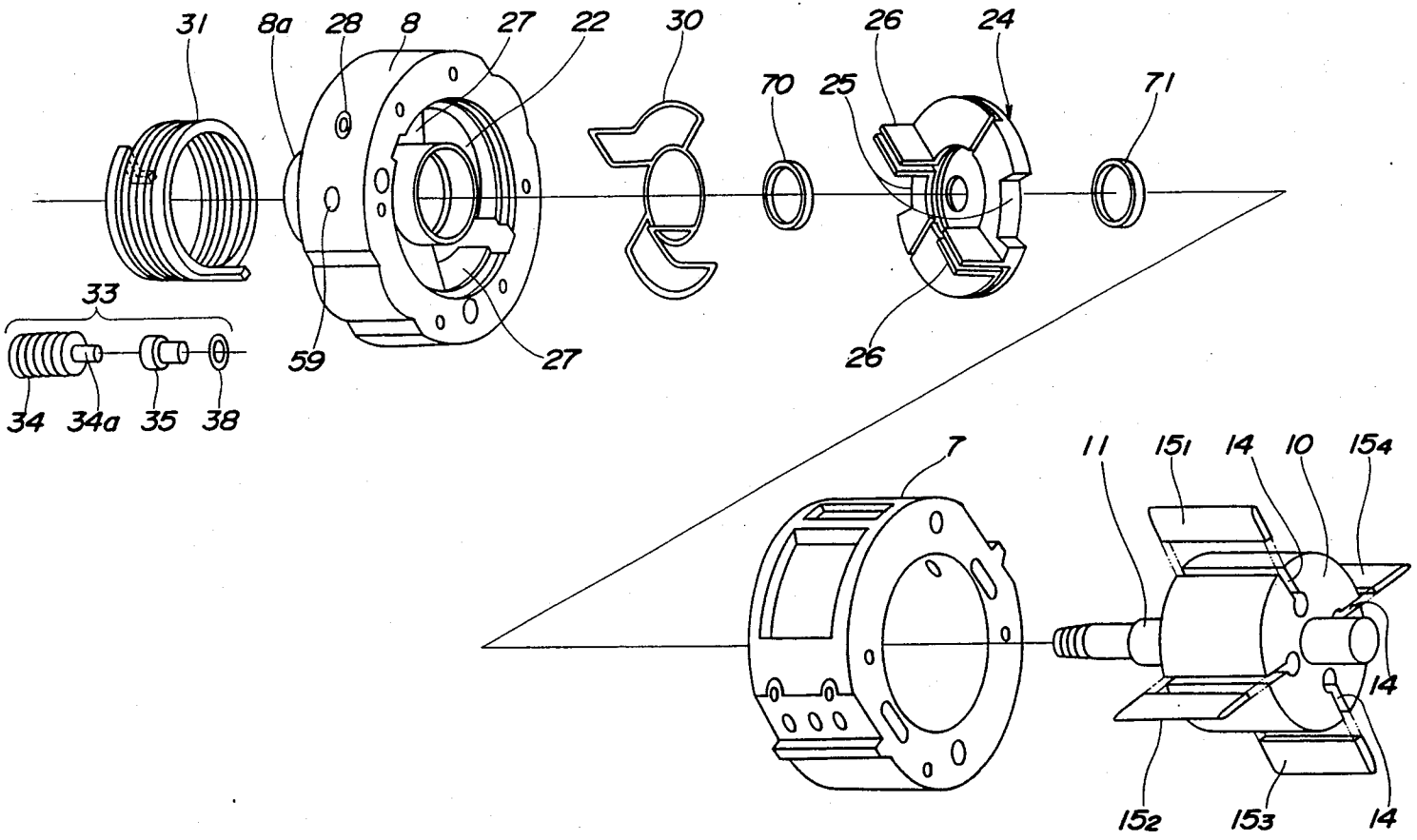
FIG. 21 is a view similar to FIG. 8, showing the fourth embodiment.

FIGS. 20 and 21 show a fourth embodiment of the invention. The fourth embodiment is distinguished from the first embodiment in that a bypass passage 59 is provided in the front side block 8, which communicates the discharge pressure chamber (higher pressure chamber) 19 with the second pressure chamber $27_2$ in a manner bypassing the restriction passage 28, and a bypass valve 60 is provided in the bypass passage 59, which is adapted to open when the pressure from this discharge pressure chamber 19 is lower than a predetermined value and to close when the same pressure is higher than the predetermined value.

As described previously, each of the arcuate spaces 27, 27 is divided into the first and second pressure chambers $27_1$ and $27_2$ by the associated (pressure-receiving) partition plate 26. The first pressure chamber $27_1$ communicates with the suction chamber 17 through the corresponding inlet port 16 and the corresponding second inlet port 23, and the second pressure chamber $27_2$ communicates with the discharge pressure chamber 19 through the restriction passage 28. As shown in FIG. 20, the two chambers $27_1$, $27_2$ are communicated with each other by way of the communication passage 29 formed in the control element 24. In the fourth embodiment, the bypass passage 59 is formed in the front side block 8 in parallel with the restriction passage 28, to connect one of the second pressure chambers $27_2$ with the discharge pressure chamber 19, and is provided therein with the bypass valve 60. The bypass valve 60 is adapted to open and close in response to the pressure from the discharge pressure chamber (higher pressure chamber) 19, and is formed of a ball valve 61, a spring 62 always urging the ball valve 61 in the opening direction, and a stopper pin 63 for supporting the ball valve 61. It is arranged such that when the pressure from the discharge pressure chamber 19 is lower than a predetermined value the force of the spring 62 causes the ball valve 61 to open the bypass passage 59, and when the pressure is higher than the predetermined value the same pressure causes the ball valve 61 against the force of the spring 62 to close the bypass passage 59.

The bypass passage 59 and the bypass valve 60 are intended to overcome the disadvantage that when the compressor is started or when it is switched to full capacity operation from partial capacity operation the pressure in the discharge pressure chamber (higher pressure chamber) 19 is low (e.g. 10 kg/cm$^2$ or lower) and due to the presence of the restriction 28, the pressure in the second pressure chamber $27_2$ can fail to rise promptly to a level sufficient to cause the control element 24 to make prompt and exact movement. The provision of the bypass passage 59 and the bypass valve 60 affords the following results: When the pressure from the discharge pressure chamber 19 is lower than the predetermined value, the spring 62 urges the ball valve 61 to open the bypass passage 59, as shown in FIG. 20, whereby the pressure in the discharge pressure chamber 19 is introduced into the second pressure chamber $27_2$ via the bypass passage 59 and thus the pressure in the second pressure chamber $27_2$ sharply rises to such a level that the control element 24 can move promptly and exactly, to thereby enable smooth starting of the compressor as well as smooth changeover from partial capacity operation to full capacity operation.

When the compressor is in full capacity operation and the pressure from the discharge pressure chamber 19 is higher than the predetermined value, the same pressure overcomes the force of the spring 62 to cause the ball valve 61 to close the bypass passage 59, whereby the same pressure is introduced into the second pressure chamber $27_2$ via the restriction passage 28. In this way, the second pressure chamber $27_2$ of the arcuate space 27 is communicated with the higher pressure chamber 19 via both the bypass passage 59 with the bypass valve 60 therein and the restriction passage 28 when the pressure from the higher pressure chamber is so low that the bypass valve 60 is opened, to thereby allow prompt introduction of the pressure from the higher pressure chamber to the second pressure chamber $27_2$. According to the fourth embodiment, smooth movement of the control element 24 and hence improved control reliability can be secured all the time during operation of the compressor.

The bypass valve 60 may be formed of an electromagnetic valve disposed to be opened and closed in response to output from a sensor for sensing the pressure from the higher pressure chamber, in place of the ball type valve as illustrated.

Although the capacity control mechanism including the control element 24, etc. is provided on the front side of the compressor in the foregoing embodiments, it may be provided on the rear side of the compressor, together with the aforedescribed various means in the respective embodiments, with equivalents operations and results to those described above.

What is claimed is:

1. A variable capacity vane compressor comprising:

a cylinder comprising a cam ring and a pair of front and rear side blocks closing opposite ends of said cam ring, said cylinder having at least one first inlet port formed therein;

a rotor rotatably received within said cylinder, one of said front and rear side blocks having an end face facing said rotor and a recess formed therein;

a plurality of vanes radially slidably fitted in respective slits formed in said rotor;

a housing accommodating said cylinder and defining a suction chamber and a discharge pressure chamber therein;

a driving shaft on which said rotor is secured, said driving shaft extending through said front side block;

power transmitting means mounted on said driving shaft at a side of said front side block remote from said rotor;

compression chambers being defined between said cylinder, said rotor and adjacent ones of said vanes and which vary in volume with rotation of said rotor for effecting suction of a compression medium from said suction chamber into said compression chambers through said at least one first inlet port, and compression and discharge of said compression medium;

at least one second inlet port being formed in said one of said front and rear side blocks and adjacent a corresponding one of said at least one first inlet port, said at least one second inlet port communicating said suction chamber with at least one of said compression chambers which is on a suction stroke;

a control element arranged in said recess formed in said end face of said one of said front and rear side blocks facing said rotor for rotation about an axis common with an axis of rotation of said rotor, said control element being so disposed that a circumferential position thereof determines the opening angle of said at least one second inlet port to thereby determine the timing of commencement of the compression of the compression medium;

said control element including a pressure-receiving portion defining a first pressure chamber supplied with a high pressure from said discharge pressure chamber and a second pressure chamber supplied with a low pressure from said suction chamber, said first and second presure chambers being arranged in said one of said front and rear side blocks, said control element being circumferentially displaceable in response to at least a pressure difference between said high pressure in said first pressure chamber and spacer means interposed between said control element and at least one of said one of said front and rear side blocks and said rotor, for maintaining a predetermined minimum clearance therebetween.

2. A variable capacity vane compressor as claimed in claim 1, wherein said spacer means comprises at least one shim interposed between said control element and at least one of said recess formed in said one of said front and rear side blocks and said rotor.

3. A variable capacity vane compressor as claimed in claim 1, wherein said spacer means comprises at least one roller bearing interposed between said control element and at least one of said recess formed in said one of said front and rear side blocks and said rotor.

4. A variable capacity vane compressor as claimed in claim 1, wherein said cam ring and said rotor have end faces thereof facing said one of said front and rear side block and axially flush with each other.

5. A variable capacity vane compressor as claimed in claim 1, wherein said end face of said rotor is slightly inserted into said recess formed in said end face of said one of said front and rear side block facing said rotor.

6. A variable capacity vane compressor as claimed in claim 1, including a plurality of back pressure chambers defined, respectively, in said slits in said rotor and opening in said end face of said rotor facing said one of said front and rear side blocks, a plurality of circumferentially arranged back pressure ports opening into said recess formed in said end face of said one of said front and rear side blocks facing said rotor and being communicatable with said back pressure chambers, and a commmunication passageway communicating said back pressure ports with said discharge pressure chamber, and wherein said control element has a cut-out portion formed therein at a location radially corresponding to said back pressure ports, said control element being so disposed that as said control element is circumferentially dispoaced to increase the opening angle of said at least one second inlet port, said cut-out portion successively opens said back pressure ports to thereby increase the total opening area of said back pressure ports.

7. A variable capacity vae compressor as in claim 1, wherein said control element is slightly axially displaceable in response to a pressure difference between opposite sides thereof.

8. A variable capacity vane compressor as in claim 1, wherein said control element further comprises biasing means for biasing said control element in a direction in which the opening angle of said at least one second inlet port increases, and wherein said control element is circumferentially displaceable in response to a pressure difference between said high pressure in said first pressure chamber and the sum of said low pressure in said second pressure chamber and a biasing force of said biasing means.

9. A variable capacity vane compressor as in claim 8, wherein said biasing means comprises a coiled spring.

10. A variable capacity vane compressor as in claim 8, wherein said control element is slightly axially displaceable in response to a pressure difference between opposite sides thereof.

11. A variable capacity vane compressor as in claim 10, wherein said biasing means comprises a coiled spring.

12. A variable capacity vane compressor as claimed in claim 1, wherein said pressure-receiving portion is circumferentially displaceable for causing circumferential displacement of said control element to vary the opening angle of said at least one second inlet port; said compressor includes a communication passageway communicating said frist pressure chamber with said suction chamber, control valve means responsive to pressure within said suction chamber for closing said communication passageway when the pressure within said suction chamber is higher than a first predetermined value and for opening said communication passageway when the pressure within said suction chamber is lower than said first predetermined value to thereby vary said high pressure in said first pressure chamber, and capacity-increasing means responsive to the pressure within said suction chamber for causing circumferential displacement of said control element in a direction in which the opening angle of said at least one second inlet port decreases when the pressure within said suction chamber is higher than a second predetermined value.

13. A variable capacity vane compressor as claimed in claim 12, including biasing means urging said control element in a direction in which the opening angle of said at least one second inlet port increases, and wherein said capacity-increasing means comprises a bellows disposed for response to the pressure within said suction chamber, and connecting means operatively connecting between said bellows and said biasing means, said bellows being deformable in response to an increase in the pressure within said suction chamber for causing corresponding deformation of said biasing means in said direction in which the opening angle of said at least second inlet port decreases.

14. A variable capacity vane compressor as in claim 12, wherein said control element is slightly axially displaceable in response to a pressure difference between opposite sides thereof.

15. A variable capacity vane compressor as claimed in claim 1, wherein said pressure-receiving portion being circumferentially displaceable for causing circumferential displacement of said control element to vary the opening angle of said at least one second inlet port, said compressor including a first communication passageway having a restriction therein and communicating said first pressure chamber with said discharge pressure chamber, a second communication passageway communicating said first pressure chamber with said suction chamber, control valve means responsive to pressure within said suction chamber for closing said second communication passageway when the pressure within said suction chamber is higher than a first predetermined value and for opening said second communication passageway when the pressure within said suction chamber is lower than said first predetermined value to thereby vary said high pressure in said first pressure chamber, a third communication passageway communicating said first pressure chamber with said discharge pressure chamber in a manner bypassing said first communication passageway, and bypass valve means arranged in said third communication passageway and responsive to pressure from said discharge pressure chamber for opening said third communication passageway when the pressure from said discharge pressure chamber is lower than a second predetermined value and for closing said third communication passageway when the pressure from said discharge pressure chamber is higher than said second predetermined value.

16. A variable capacity vane compressor as claimed in claim 15, wherein said first and third communication passageways are formed in said one of said front and rear side block in parallel with each other.

17. A variable capacity vane compressor as in claim 15, wherein said control element is slightly axially displaceable in response to a pressure difference between opposite sides thereof.

18. A variable capacity vane compressor as claimed in claim 1, wherein said pressure-receiving portion is circumferentially displaceable for causing circumferential displacement of said control element to vary the opening angle of said at least one second inlet port, said compressor including a communication passageway having a valve seating portion and communicating said first pressure chamber with said suction chamber, control valve means having a valve body disposed in said communication passageway, and actuator means responsive to pressure within said suction chamber for urging said valve body to be displaced in a manner such that said valve body is seated on said valve seating portion of said communication passageway to close said communication passageway when the pressure within said suction chamber is higher than a first predetermined value and disengaged from said valve seating portion when the pressure within said suction chamber is lower than said first predetermined value to thereby vary said high pressure in said first pressure chamber, and urging means responsive to pressure from said discharge pressure chamber for always urging said valve body toward said valve seating portion of said communication passageway during operation of said compressor.

19. A variable capacity vane compressor as in claim 18, wherein said control element is slightly axially displaceable in response to a pressure difference between opposite sides thereof.

20. A variable capacity vane compressor as claimed in claim 18, wherein said urging means includes a second communication passageway communicating between said discharge pressure chamber and said first-mentioned communication passageway, and a plunger slidably fitted in said second communication passageway for always urging said valve body toward said valve seating portion of said first-mentioned communication passageway.

21. A variable capacity vane compressor as claimed in claim 20, wherein said actuator means of said control valve means comprises a bellows disposed within said suction chamber and expandable with a decrease in the pressure within said suction chamber for urging said valve body.

22. A variable capacity vane compressor as claimed in claim 20, wherein said valve body of said control valve means comprises a ball valve.

* * * * *

UNITED STATES PATENT AND TRADEMARK OFFICE

CERTIFICATE OF CORRECTION

PATENT NO. : 4,744,732

DATED : May 17, 1988

INVENTOR(S) : NAKAJIMA et al

It is certified that error appears in the above-identified patent and that said Letters Patent is hereby corrected as shown below:

Title page, left-hand column, "U.S. Patent Documents", insert -- 3,206,218 9/1965 Potter --

Column 19, line 61, "dispoaced" should read -- displaced --

Column 19, line 65, "vae" should read -- vane --

Column 20, line 24, "port; said" should read -- port; and said --

Signed and Sealed this

Twenty-fourth Day of January, 1989

*Attest:*

*Attesting Officer*

DONALD J. QUIGG

*Commissioner of Patents and Trademarks*